United States Patent [19]

Raasch

[11] 4,150,534

[45] Apr. 24, 1979

[54] METHOD AND APPARATUS FOR EXCHANGING SLIVER CANS

[75] Inventor: Hans Raasch, Mönchen-Gladbach, Fed. Rep. of Germany

[73] Assignee: W. Schlafhorst & Co., Mönchen-Gladbach, Fed. Rep. of Germany

[21] Appl. No.: 842,309

[22] Filed: Oct. 14, 1977

[30] Foreign Application Priority Data

Oct. 14, 1976 [DE] Fed. Rep. of Germany ..... 2646313

[51] Int. Cl.[2] ..... D01H 9/18

[52] U.S. Cl. ..... 57/281; 19/159 A; 57/276; 57/90

[58] Field of Search ..... 57/34 R, 52, 54, 90, 57/156, 1 R; 19/159 A

[56] References Cited

U.S. PATENT DOCUMENTS

| | | | |
|---|---|---|---|
| 3,083,415 | 4/1963 | Osaki et al. | 19/159 A |
| 3,125,782 | 3/1964 | Kaino et al. | 19/159 A |
| 3,698,041 | 10/1972 | Hertzsch | 19/159 A |
| 3,716,979 | 2/1973 | Handschuh et al. | 57/34 R |
| 3,884,026 | 5/1975 | Yoshizawa et al. | 57/34 R |
| 3,973,906 | 8/1976 | Tooka | 57/34 R X |
| 4,012,893 | 3/1977 | Weber | 57/34 R |
| 4,033,104 | 7/1977 | Kamp | 57/34 R |

*Primary Examiner*—John Petrakes
*Attorney, Agent, or Firm*—Herbert L. Lerner

[57] ABSTRACT

Method of exchanging sliver cans of a spinning machine having individual spinning stations, the sliver cans being disposed in staggered array adjacent and behind one another, by means of a can exchanging device able to travel on a given travel path along the spinning machine which includes placing the sliver cans in groups of at least three cans on turntables installed below the respective spinning stations of the spinning machine, conducting the can-exchanging device with at least one filled sliver can carried thereby in operating readiness past the groups of at least three cans at the respective spinning stations, stopping at a respective spinning station in response to a signal "sliver missing" from the spinning station and automatically carrying out the following operating steps:

(a) turning the turntable into can-exchanging position if the turntable is not already in such position;
(b) removing from the turntable the sliver can to be exchanged;
(c) delivering the filled sliver can from the can exchanging device to the turntable;
(d) turning the turntable back into operating position thereof if necessary;
(e) conducting the can-exchanging device to a loading station and surrendering thereto the removed sliver can;
(f) and providing the can-exchanging device with another filled sliver can to be carried thereby.

14 Claims, 24 Drawing Figures

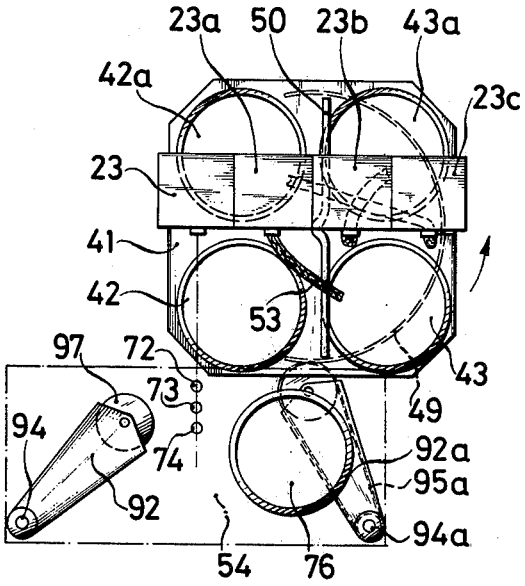
FIG. 2a
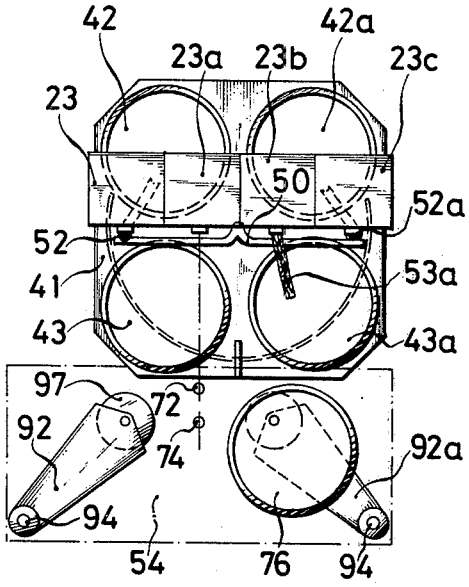
FIG. 2b
FIG. 2c
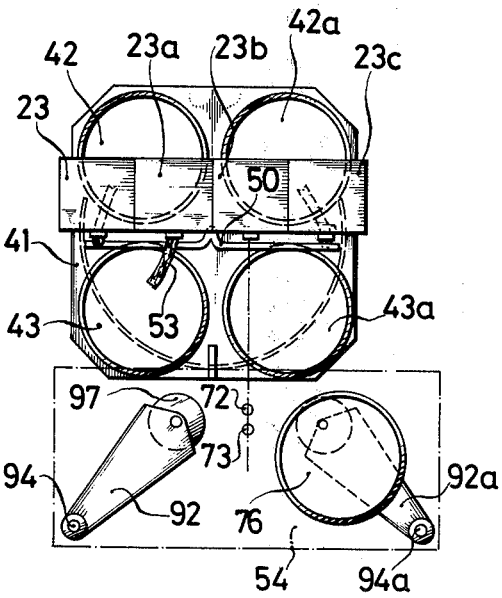
FIG. 2d
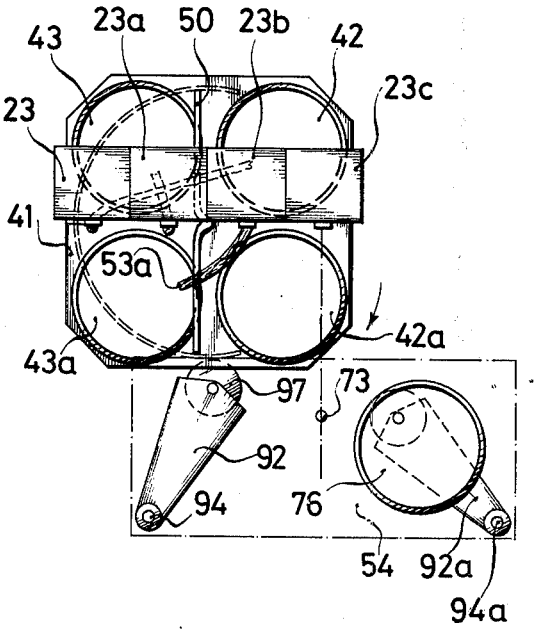

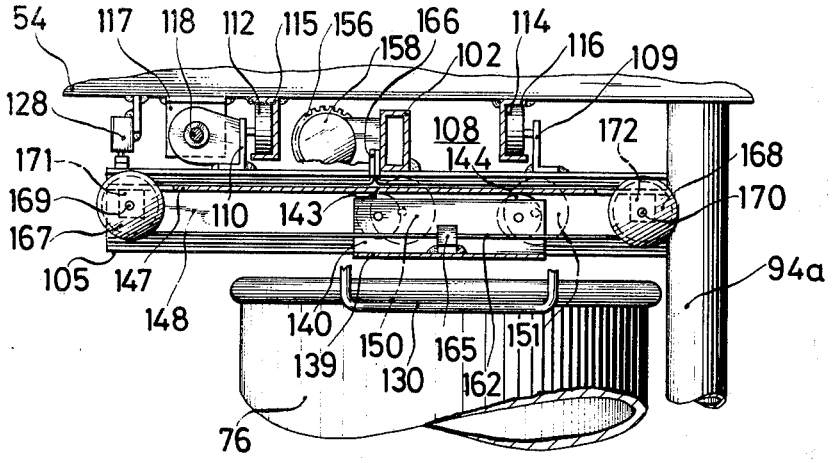
FIG. 5a
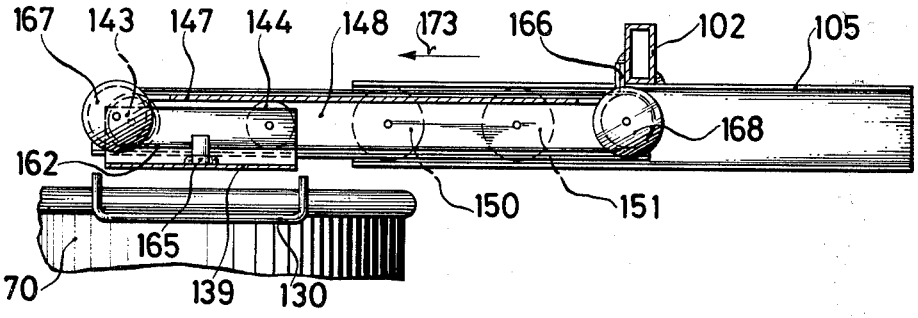
FIG. 5b
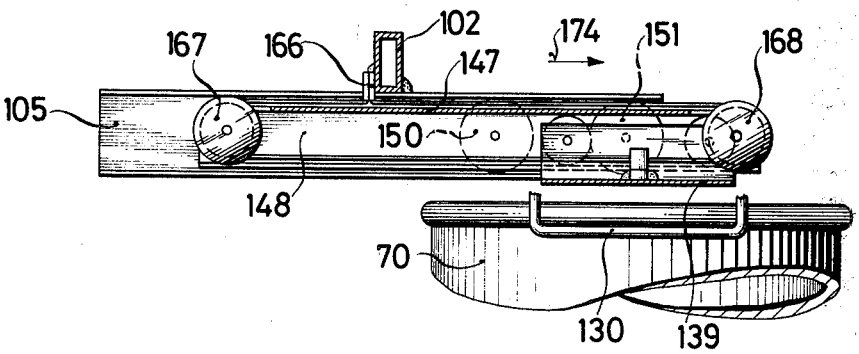
FIG. 5c
FIG. 6
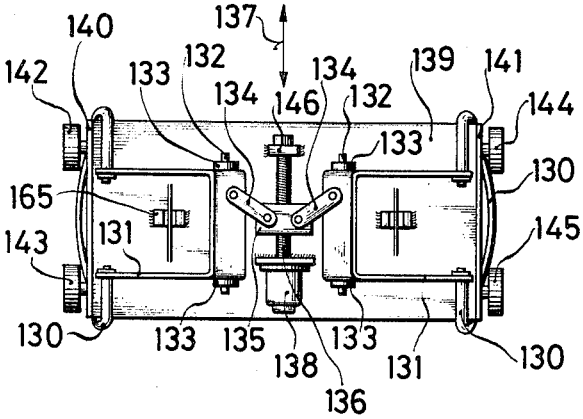
FIG. 7
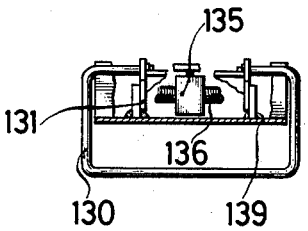

METHOD AND APPARATUS FOR EXCHANGING SLIVER CANS

The invention relates to a method and apparatus for exchanging the sliver cans which are arranged staggered side by side and behind each other, of a spinning machine composed of individual spinning stations, particularly of a rotor spinning machine, by means of a track-bound can exchange device that can be moved alongside the spinning machine.

In spinning machines, sliver cans that are running empty are customarily exchanged for full cans by hand. The operating time required therefor is quite considerable and is further increasing relative to the spinning time, as the running time of the sliver presented becomes shorter and shorter in modern spinning machines. The reason for this is the increasing operating speed of the machines and the decreasing operating width of the individual spinning stations. The size of the sliver cans is thereby limited even if they are arranged staggered side by side and behind each other. Full sliver cans must therefore always be kept in reserve in the service aisles between the spinning machines, whereby the exchange operations are additionally made more difficult because of the cramped space.

It is an object of the invention to accelerate and automate the exchanging of sliver cans. According to the invention, this problem is solved by providing that the sliver cans are arranged in threes or fours on turntables installed underneath the spinning sets of the spinning stations, the three or four spinning stations assigned to the sliver cans of a turntable forming a spinning station group; and wherein the can exchange device is loaded at an end face of the spinning machine with at least one full sliver can and is led past the spinning station groups in the shuttle or circulating travel mode, ready to go into operation; stops upon an alarm signal "no sliver" from a spinning station at the spinning station or spinning station group in question; and executes or initiates the following automatice operations: Rotating the turntable into the exchange position; unless the sliver can to be exchanged is already in the exchange position; removing the sliver can to be exchanged from the turntable; delivering the full sliver ca to the turntable; and, if required, turning back the turntable into the operating position. Thereupon, the can exchange device is conducted to a loading station where it delivers the picked-up sliver can and receives a full sliver can again at the same location or at a separate loading location.

If the complement of the turntables is only three sliver cans, the three spinning stations form a spinning station group, and if it is four sliver cans, then four spinning stations always form a spinning station group. The can exchange device can be called up by the disturbed spinning station directly by a drag cable or, as the can exchange device travels past the spinning station, by alarm devices arranged for this purpose such as, for instance, a reflex light gate.

As the exchange of cans is automatic, the operating personnel need not be alerted specially. So that the spinning station is taken into operation again as soon as possible after the can exchange, it is proposed in a further embodiment of the invention that the can exchange device sets a signal for joining after the cans are exchanged. This signal can be intended for an operator or also for a joining device.

The reason for the missing sliver may be, in an individual case, a sliver break, so that the can is still more or less full. In that case, it may be desirable not to exchange the can. It is therefore proposed that the can exchange device determine the degree of fullness of the sliver can to be exchanged by means of a sensor and, if the degree of fullness is sufficient, does not exchange the sliver can but sets a signal for joining.

Joining after an ordinary thread break differs from joining after the sliver can has run empty or after a sliver break. After a normal thread break, there is still sliver in the breaking-up loosening device. The thread end on the take-up coil has normal thread cross section up to shortly before the break location. This is not the case if the sliver breaks or runs out; then, the thread cross sectin is diminished over a longer run-out distance. Taking this aspect into consideration, it is proposed therefore, that, if an automatic cleaning and/or joining device is provided, the signal set by the can exchange device for joining causes at the same time a program change of the cleaning and joining device to the effect that the sliver is fed-in already prior to the cleaning operation so far that a full sliver cross section is present at the loosening roller of the spinning set and a thread end longer than usual is drawn off the take-up coil and is removed.

For implementing the new method, it is proposed to arrange the sliver cans by threes or fours on turntables installed underneath the spinning sets of the spinning stations, where the three or four spinning stations assigned to the sliver cans of a turntable form a spinning station group and the can exchange device can be loaded at an end face of the spinning machine in a loading station with at least one full sliver can and can be led past the spinning station groups in a shuttle or circulating travel mode, ready to go into operation; can be stationed, upon an alarm signal "no sliver" of a spinning station, at the spinning station in question and arranged by means of a sequence switching device to subsequently execute or initiate the following operations: Rotating the turntable into the exchange position of the sliver can unless the sliver can to be exchanged is already in the exchange position; removing the sliver can to be exchanged from the turntable; delivering the full sliver can to the turntable; turning back the turntable into the operating position if necessary; and arranging and programming the can exchange device for the subsequent return to the loading station, delivering the exchanged sliver can and picking up a new, full sliver can.

For carrying out the can exchange, the can exchange device can be stopped either exactly in front of the spinning station in question, or temporarily at a given location in front of the turntable or the spinning station group. According to a further feature of the invention, the can exchange device is therefore characterized by means for stopping and temporarily latching in a predetermined operating position at the spinning station or spinning station group to be serviced.

In a further embodiment of the invention, the can exchange device possesses, for the exchange operation programmable means for moving the sliver cans in more than one direction of motion, in relation to the can exchange device itself. With, for instance, two programmed manipulators, it is possible, for instance, to grip and deposit one full and one empty sliver can and to move them lengthwise and transversely to the machine according to a program. If four cans, for instance, are placed on the turntables, which are assigned according to a certain order system to the four spinning stations of the spinning station group, particularly in such a manner that, when the turntables are rotated through 90° from the central position, trouble-free running of all slivers is still ensured, then the sliver cans of a spinning station group each have different operating positions and distances from the corresponding spinning stations. If now the can exchange device is to be stopped always at that spinning station, whose sliver can is to be exchanged, one obtains four different programs for the movement of the manipulators which must exchange the sliver cans. It is therefore advantageous if the three or four spinning stations of a spinning station group have differently coded signaling devices, while the can exchange device itself has a device for decoding the code regarding the position of the disturbed spinning station in the spinning station group. Each spinning station thus has its own coding, according to which the proper can exchange program can be selected from a program memory of the can exchange device.

In a further embodiment of the invention it is proposed that the can exchange device have at least one drive for the turntables of the sliver cans that can be programmed and engaged or disengaged.

The cans of a group of four, which stand on the turntables in the back row, can be brought, for instance, by rotating the turntable 90° out of the central position, into the front row, so that they get into the operating range of the can exchange device.

The can exchange device has advantageously a sensor for determining the degree of fullness of the sliver cans to be exchanged. If the sensor has determined, for instance, that the sliver can is not yet emptied far enough, it can release a skip command to the program switching mechanism, so that the can exchange commands of the program are skipped and the sliver can remain standing on the turntable. The sensor can be, for instance, a proximity switch which responds to the metallic spring bottom of the sliver can. As is well known, the sliver is filled into the sliver can on such a spring bottom. Under the weight of the progressively filled sliver, the metallic spring bottom sinks downwardly against the force of a spring in such a manner that the sliver always extends to the upper edge of the sliver can, regardless of the amount of sliver contained in the can.

A particularly advantageous embodiment of the invention is obtained by combining the can exchange device with a cleaning and/or joining device. This can save a separate track and a separate carriage for the can exchange device, and the wire connections between the two devices are particularly short. In addition, the cleaning and joining program can already start before the can exchange operation is entirely finished.

The can exchange device advantageously comprises a device for signaling the completion of the exchange operation to the operator and/or to a cleaning and/or joining device. The time between a can exchange and the subsequent joining should be kept as short as possible. This applies particularly also to the case that the joining must be done by hand, as no automatic joining device is provided.

In another embodiment of the invention, the can exchange device has a movable, program-controllable clamp (or clip) for the sliver end. The car exchange device can have, for instance, an operable clamp attached to a swivel arm, by means of which the sliver end of a full sliver can is held during the transport and by means of which it can be inserted into the feeding funnel of a spinning set. To this end, the feeding funnel is advantageously designed, in a manner known per se, so that it can be pulled out of the spinning set so that it is open toward the top in the pulled-out condition and the sliver end can easily be transferred from the clamp. To the swivel arm mentioned can be connected, for instance, a tie rod which is hooked into the feeding funnel if the swivel arm is swung into the region of the feeding funnel. By a motion superimposed on the swivel motion, the feeding funnel is then pushed into, and then out of the spinning device again. The movement of the swivel arm, of the clamp and of the tie rod may likewise be controlled according to a program.

If the spinning machine is equipped with a movable cleaning and joining device, the can exchange device advantageously has a code for the signal "exchange completed" such that a change of the normal operating program occurs at the cleaning and/or joining device to the extent that the sliver can be fed-in prior to the cleaning operation so far that a full sliver cross section is present at the loosening roller of the spinning set and a thread end longer than usual can be pulled off and removed from the take-up coil. The entire length of the thread end that was spun with too small a thickness during the sliver run-out is therefore to be pulled off and removed from the take-up coil. The full sliver cross section is to be present at the loosening roller already prior to the cleaning operation, so that a sufficient amount of fiber is available at the starting time in the joining process.

At one narrow side of the spinning machine, a loading station is advantageously provided in the extension of the machine, at which the can exchange device can take on full sliver cans and discharge empty cans. For this purpose it is proposed that the means for moving the sliver cans (manipulators) of the exchange device can also be used for discharging and taking on sliver cans at a loading station. For this purpose, the manipulators must be fitted specially, as the loading of the sliver cans at the loading station takes place on another side of the device than the unloading at the spinning station or spinning station group.

The loading station for implementing the proposed method and for loading and unloading the can exchange device has advantageously as platform movable toward the can exchange device to facilitate the transfer of cans. The loading station may have, for instance, a slide shifter, a carriage, a roller track or the like, on which the full sliver can can be brought toward the can exchange device and the empty can be taken over. Also the manipulators of the can exchange device are advantageously advanced in the direction toward the loading station in order to facilitate the discharge and transfer of the sliver cans in this manner.

For the movement of the elements of the can exchange device at the loading station, a separate program is advantageously stored, which is selected, for instance, when the can exchange device is latched at the loading station.

In a further embodiment of the invention, it is proposed that the loading station comprises at least one shifting device for transporting the cans and, if desired, the separately held sliver ends to a transfer point and/or away from a transfer point. The sliver ends can, for instance, be laid out ready for use in longitudinally movable clamps, from which the clamp of the can exchange device, arranged at a swivel arm, takes the sliver end when the full sliver can is taken over.

For better utilization of the floor area at the loading station, it is advantageous if for both the full and the empty sliver cans at least two supply rows are available. The full or empty sliver cans, respectively, can advantageously be taken on, or given off, from the inner rows and the full sliver cans shifted for this purpose in rhythm from the outside to the inside and the empty cans from the inside to the outside by means of a preferably common pushing device.

As an alternative thereto, it is proposed that the loading station have a sliver drawing mechanism followed by a canfilling device. Thereby, a closed sliver can cycle in the spinning machine is obtained. The supply for the sliver drawing device can therefore consist of sliver with a large cross section in correspondingly larger transport containers. It is then a possible advantage to insert the sliver, after a sliver can is filled, automatically into a movable clamp and cut it to a point before the next sliver can is filled. The can exchange device can then take over the sliver end from the movable clamps when the sliver cans are transferred. The loading station therefore has advantageously a device for holding the sliver ends and for transferring the sliver ends to the can exchange device.

The advantages achieved with the invention are in particular that all operations pertaining to the changing of the sliver cans can be performed completely automatically, with little floor space required, and the idle times of the spinning machine are further reduced. In the following sections, the invention will be described and explained in further detail with the aid of an embodiment example shown in the drawings.

Other features which are considered as characteristic for the invention are set forth in the appended claims.

Although the invention is illustrated and described herein as embodied in a method and device for exchanging sliver cans, it is nevertheless not intended to be limited to the details shown, since various modifications may be made therein without departing from the spirit of the invention and within the scope and range of equivalents of the claims.

The invention however, together with additional objects and advantages thereof will be best understood from the following description when read in connection with the accompanying drawings, in which:

FIG. 1 is a side elevational view of a sliver-can exchange device;

FIGS. 2*a* to 2*d* are top plan views of the sliver can exchange device at four different operative positions of a grouping of four of the sliver cans;

Figure 10:
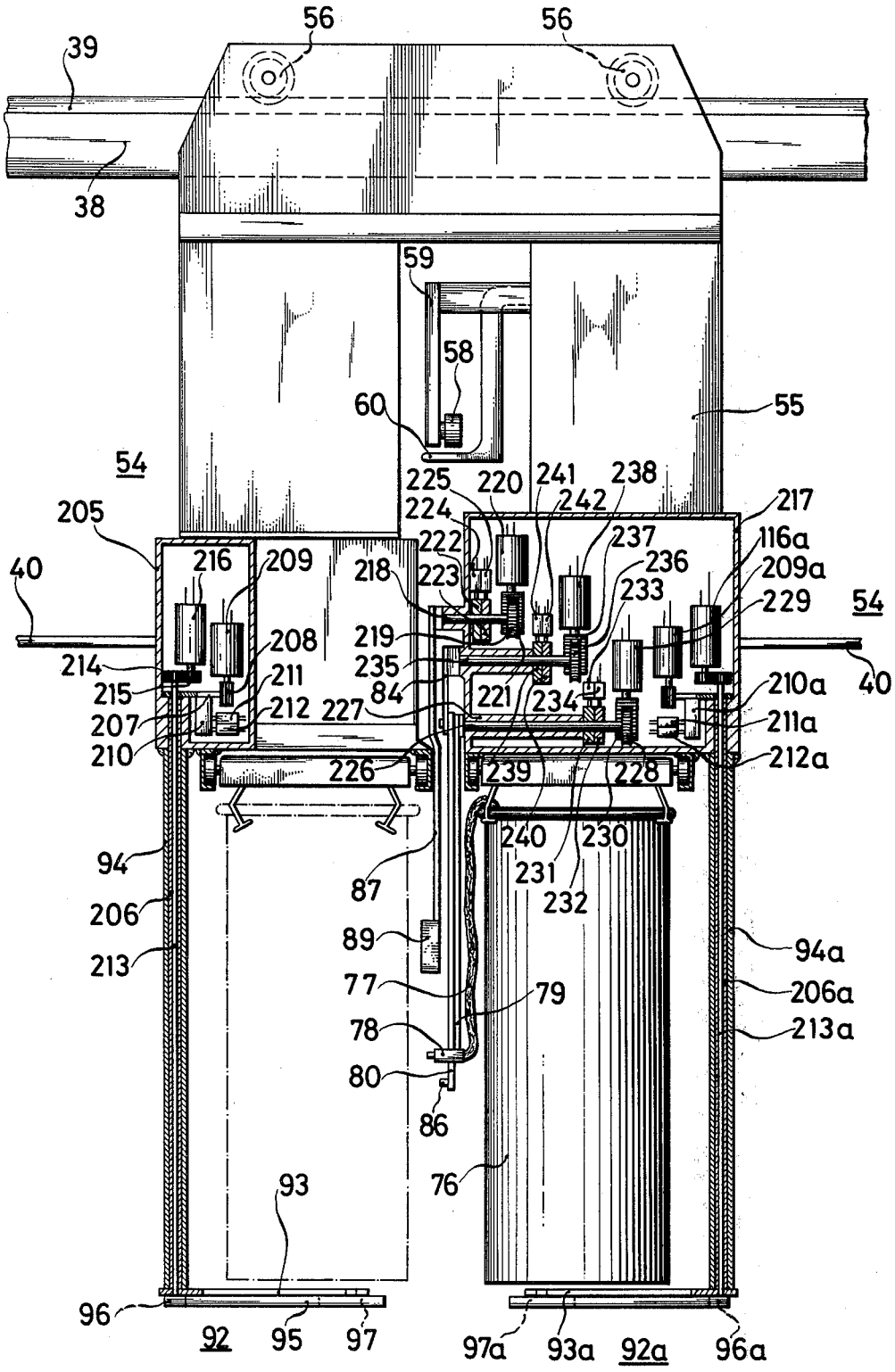
Figure 11:
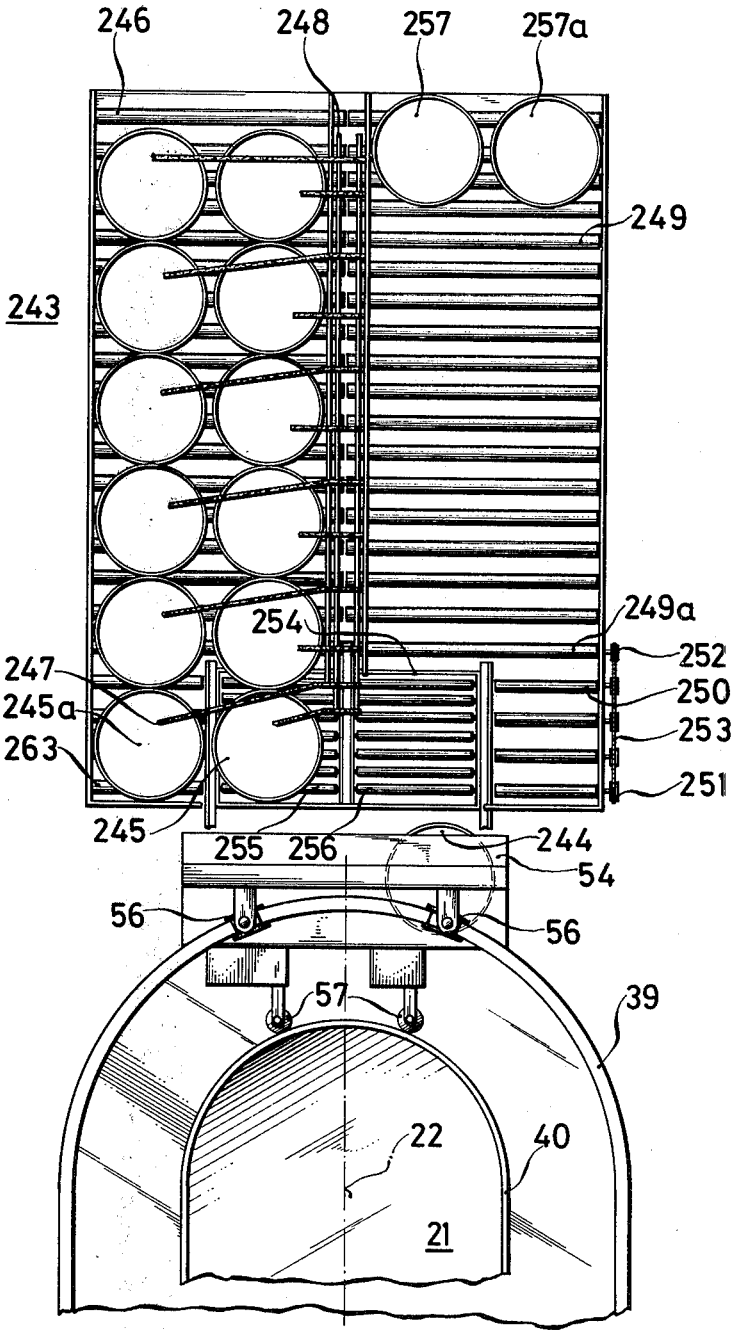
Figure 12:
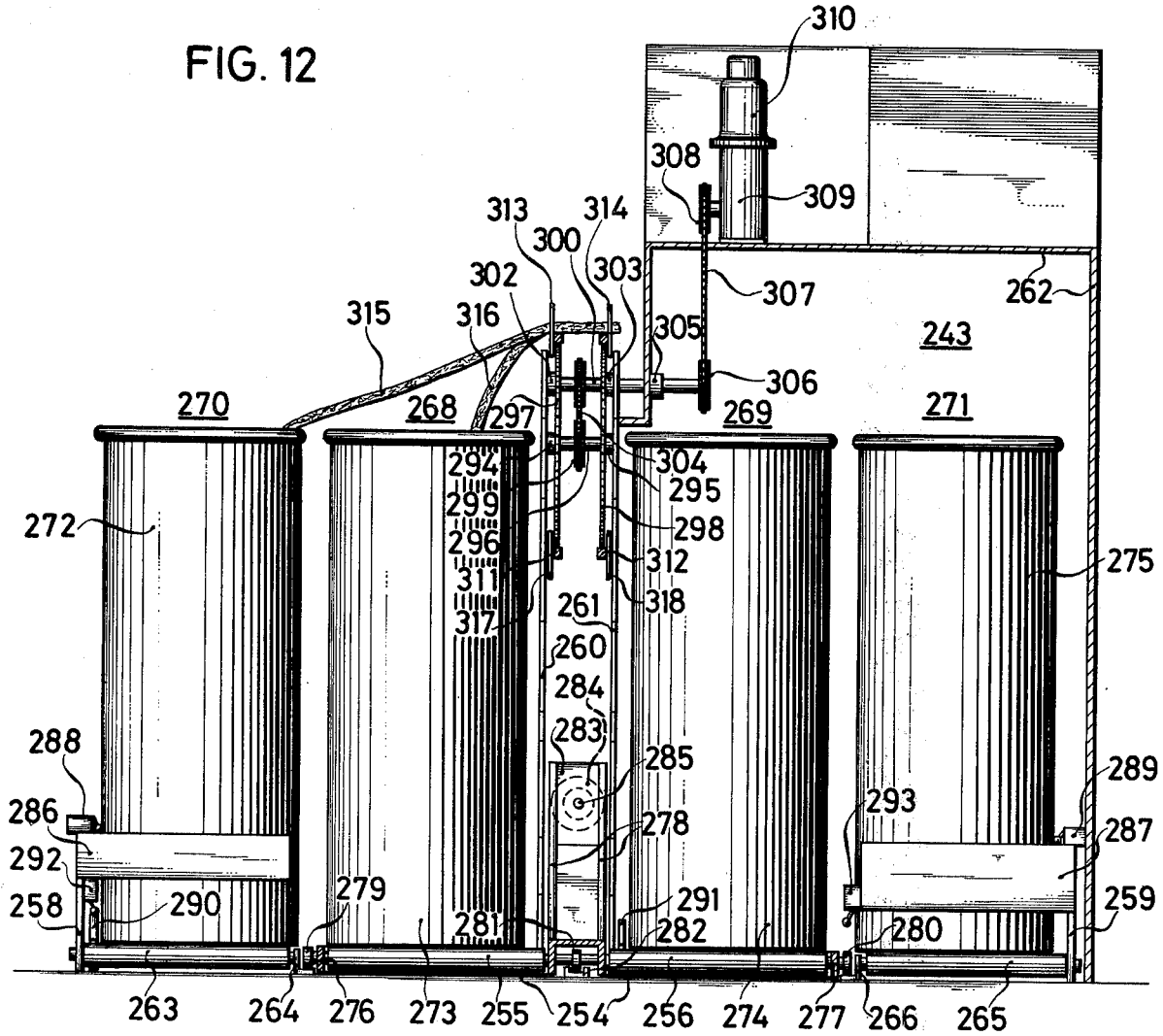
Figure 13:
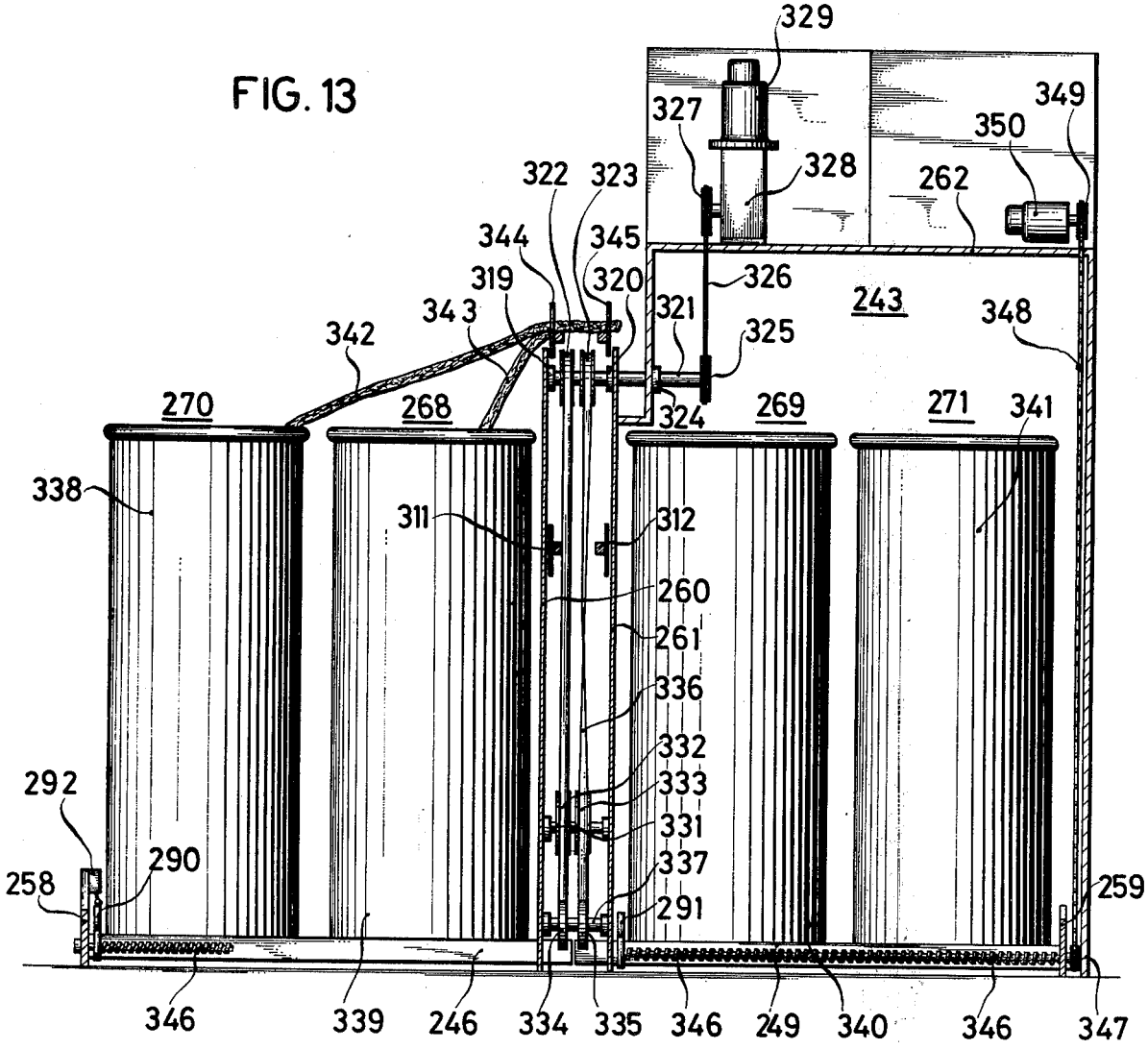
Figure 14:
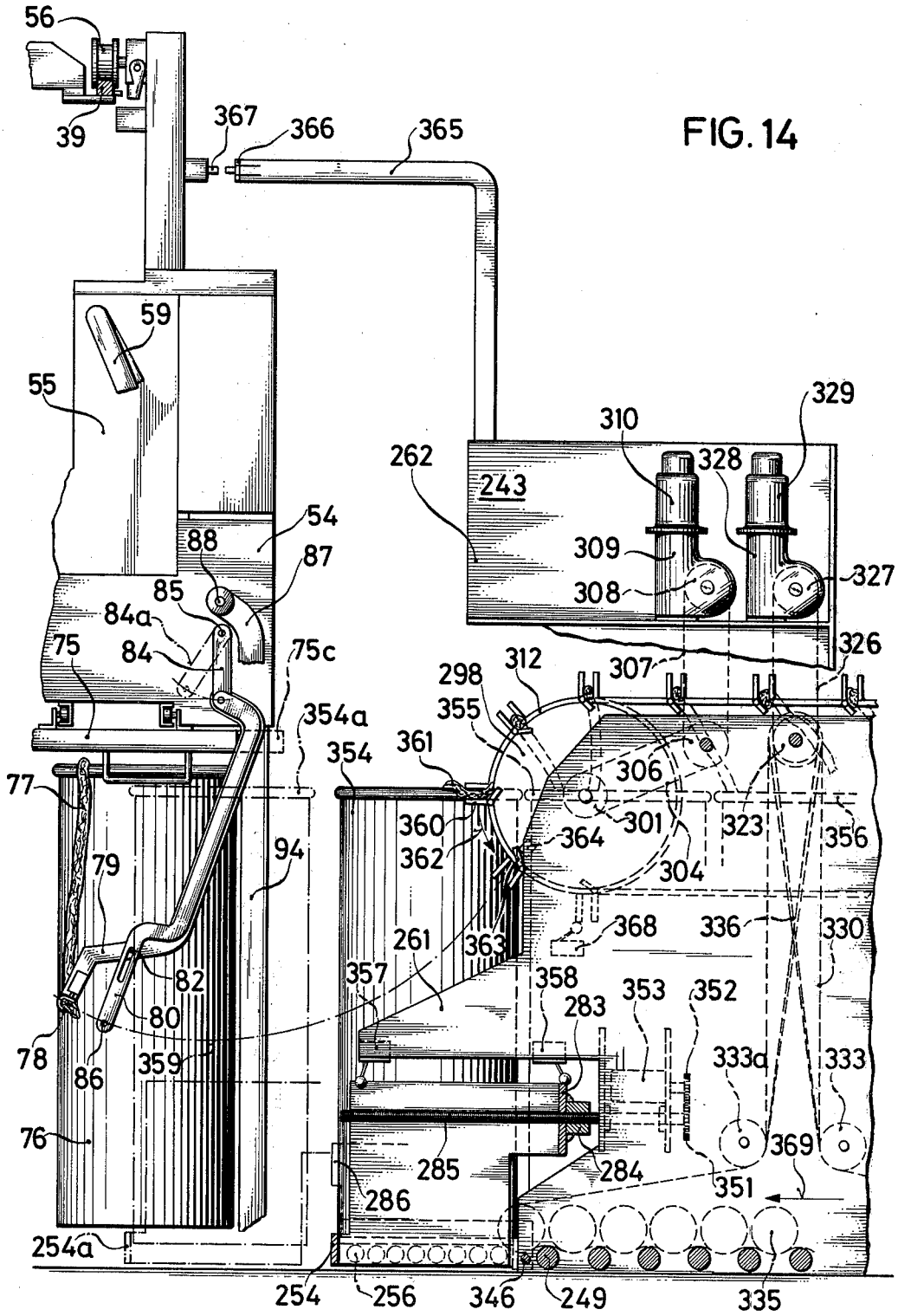
Figure 15:
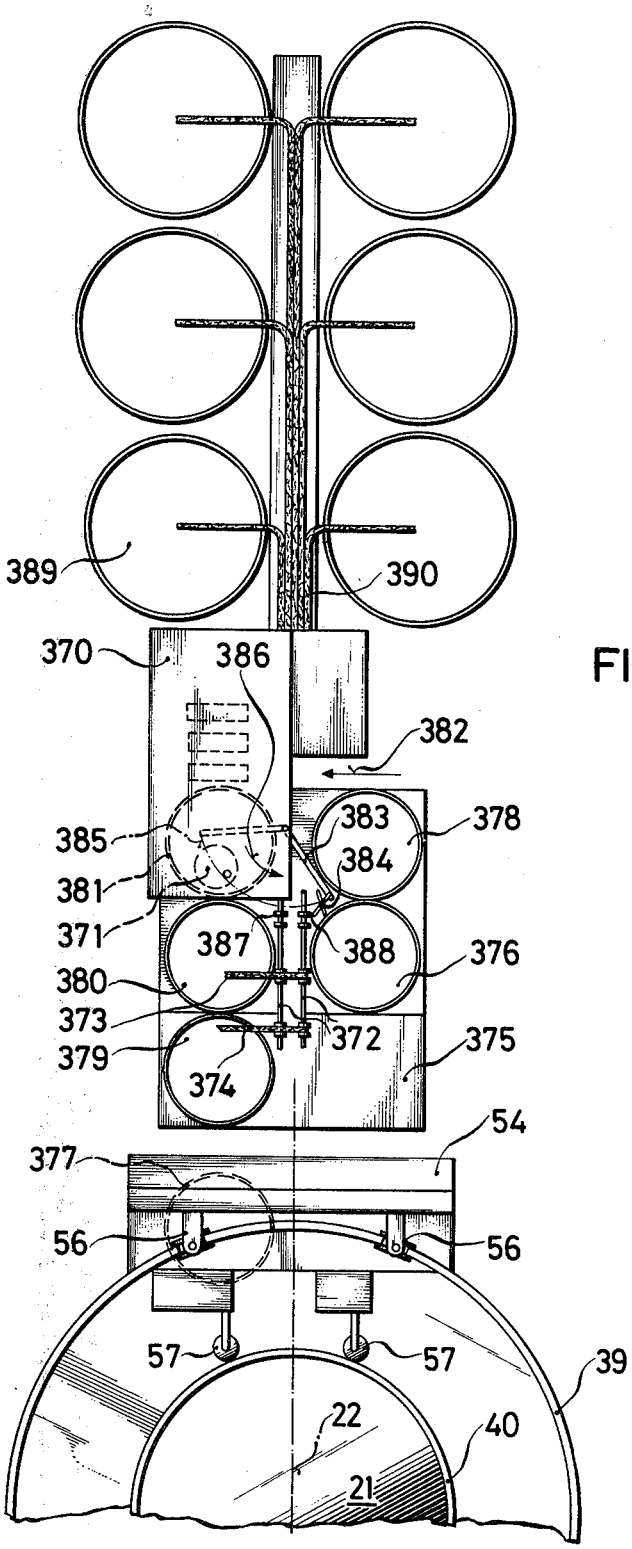
Figure 16:
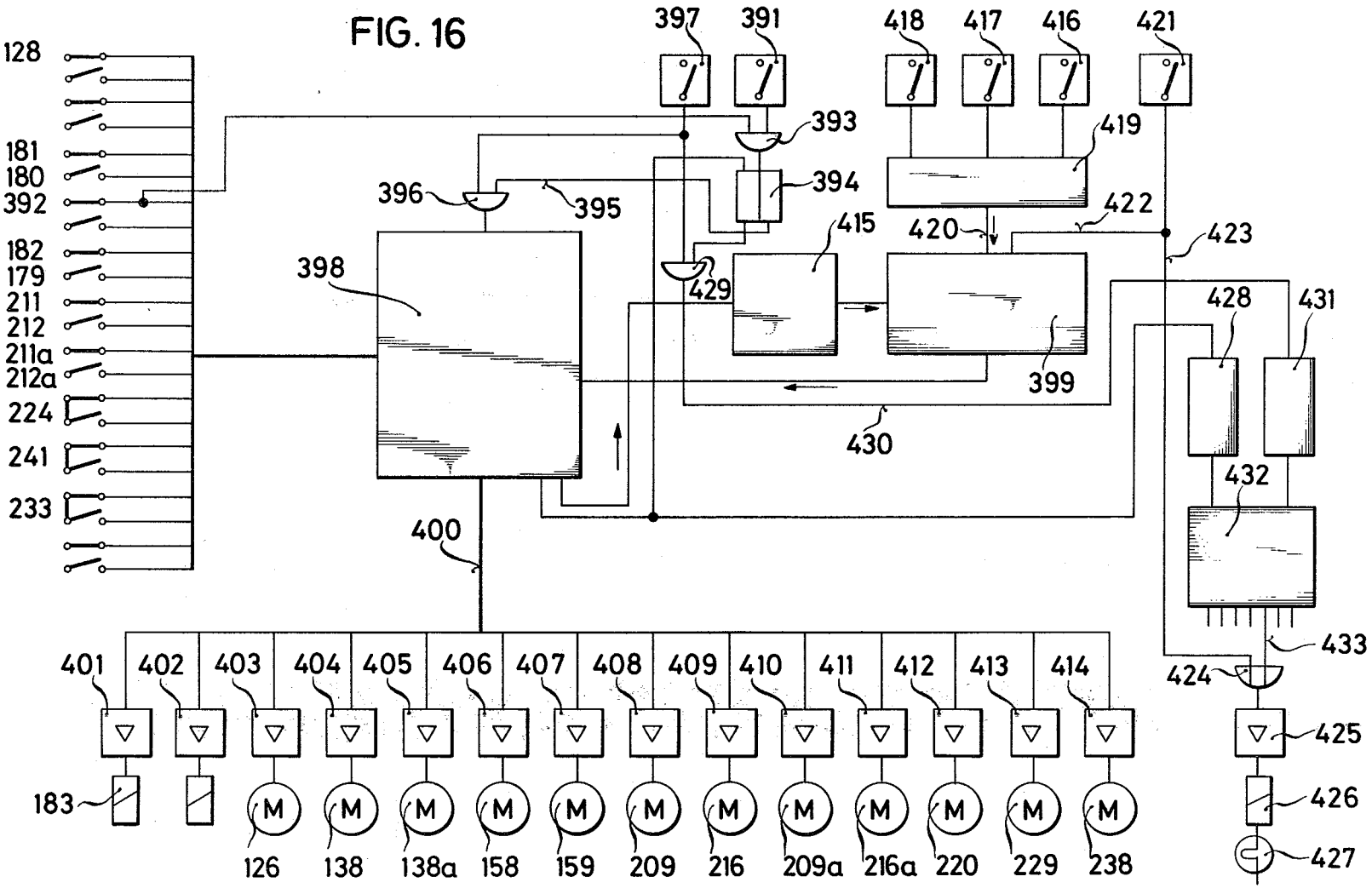
Figure 17:
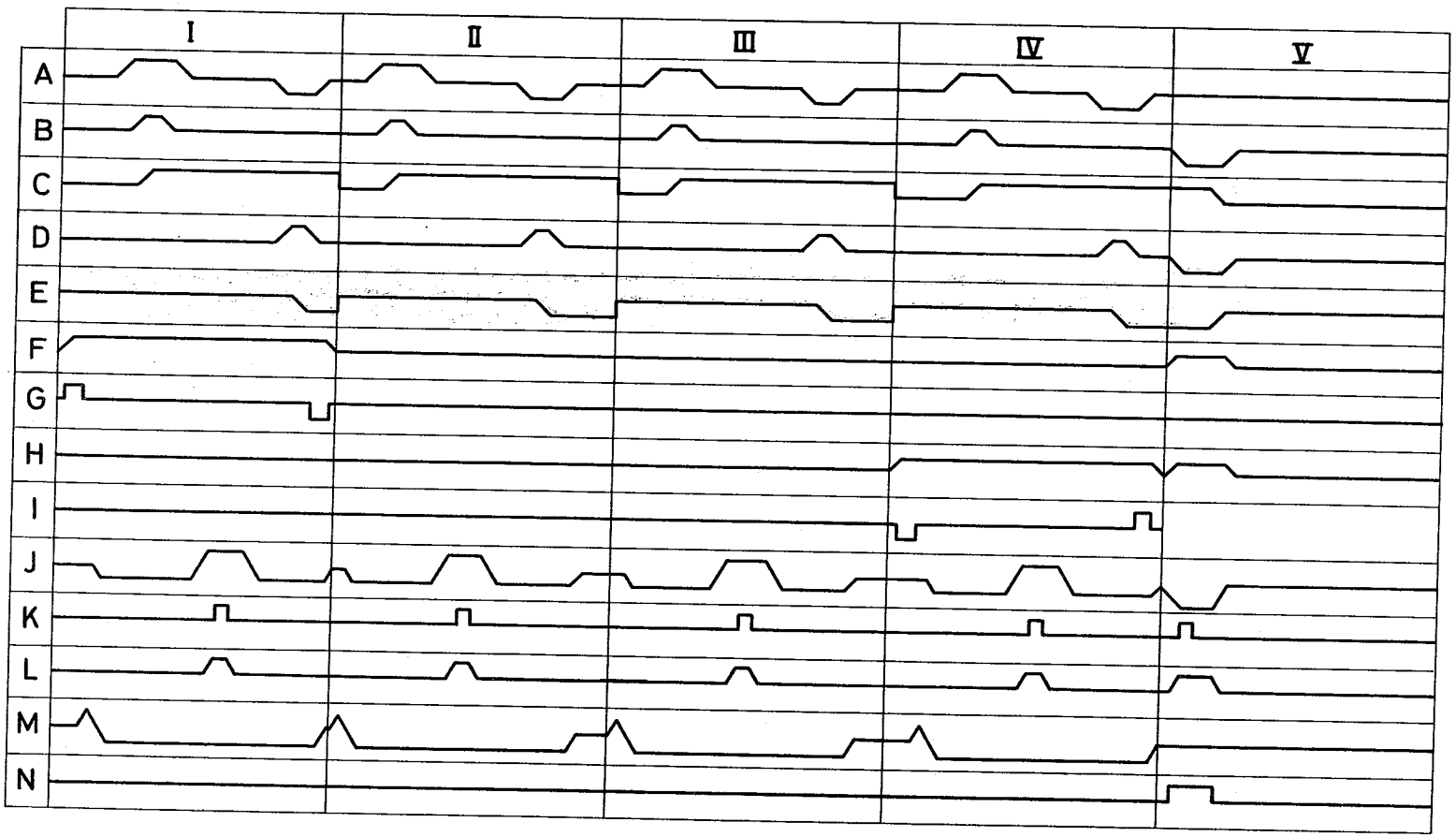

FIG. 5*a* and 5*c* are side elevational views of details of a manipulator in three different positions thereof;

FIGS. 6 and 7 show further details of a manipulator;

FIGS. 8*a*, 8*b*, 9*a* and 9*b* are side elevation and front views showing details of the device for transferring sliver to a spinning station;

FIG. 10 is a front elevational view, partly in section, of the sliver-can exchange device;

FIG. 11 is a top plan view of a loading station, at which the sliver-can exchange device is parked;

FIG. 12 is a rear view of the loading station;

FIG. 13 is another view taken along a sectional plane through the loading station, in conjunction with a partial rear view;

FIG. 14 is a side elevational view of the loading station in conjunction with a partial cross section;

FIG. 15 is a top plan view of a sliver drawing and can filling mechanism with the can exchanging device;

FIG. 16 is a block circuit diagram of the sliver-can exchange device of the invention; and FIG. 17 are time-displacement diagrams of the sliver-can exchange device for five programs.

Figure 1:
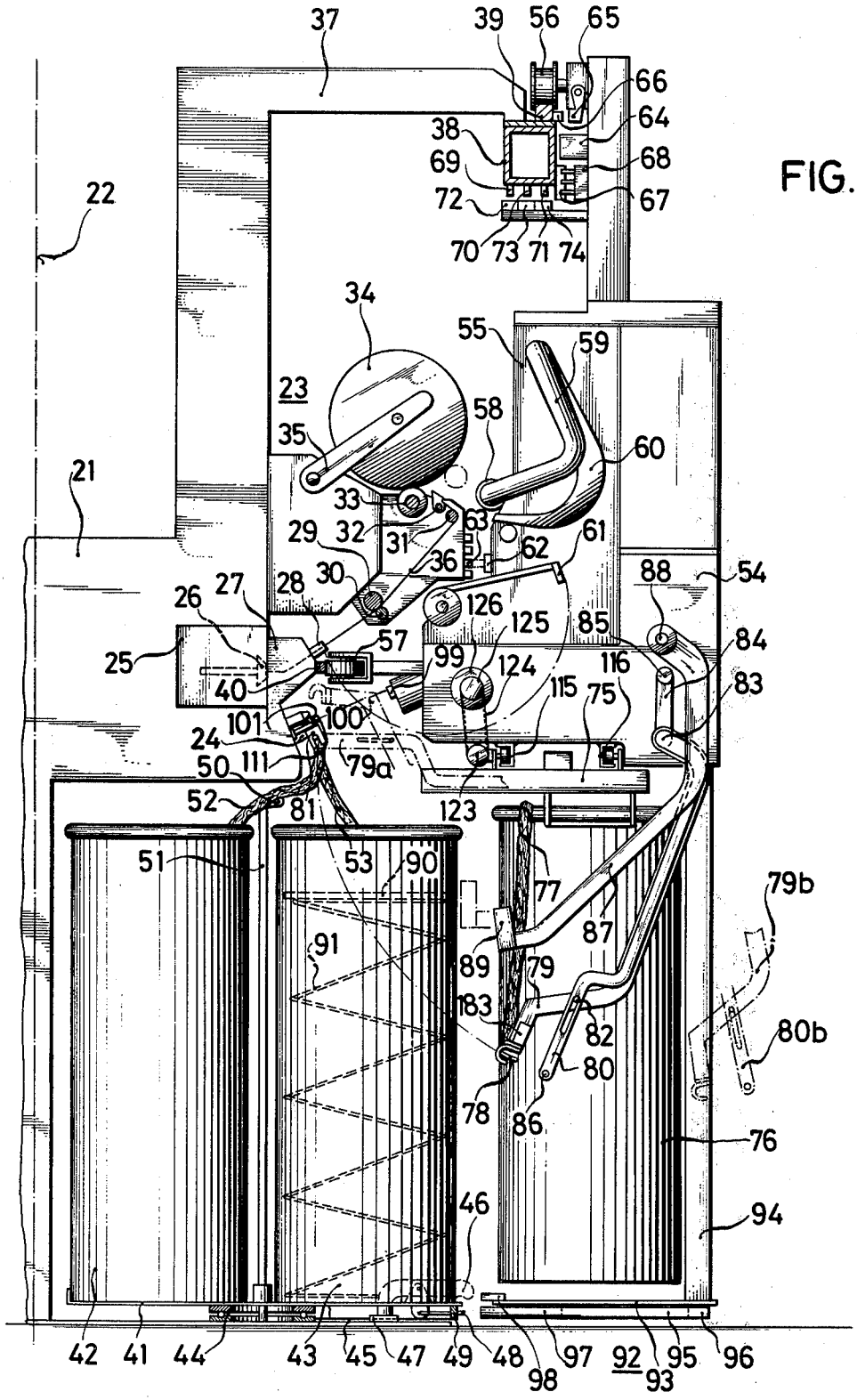

Referring now to FIG. 1, there is shown a two-sided rotor spinning machine 21, of which, however, only the right-hand machine side is illustrated. The left-hand machine side is on the left-hand side of the center line 22. Shown at the spinning machine 21, is an individual spinning station 23 with a sliver feeding device 24, a rotor housing 25 with a spinning rotor 26, a housing cover 27 with a sliver-withdrawing tube 28, a withdrawal roller pair 29, 30, a thread guiding wire 31 and a thread guide 32, a drive roller 33 for a take-up coil 34 which is held by a coil holder 35 and winds the spun thread 36 in cross layers.

Also visible at the rotor spinning machine 21 in FIG. 1 is a support arm 37 for holding a support tube 38 which extends along the spinning machine and on which a rail 39 is mounted. Another rail 40 extends along and in front of the housing cover 27.

Below the spinning station 23 there is seen a turntable 41 whereon sliver cans 42, 43 are disposed. Altogether, four sliver cans stand on the turntable. Only two sliver cans 42, 43 are visible in FIG. 1 of the drawing, the sliver can 42 belonging to the rear and the sliver can 43 to the front rows of the cans.

The turntable 41 is connected by a bearing 44 to a base plate 45. In the middle position of the turntable 41 as illustrated in FIG. 1, the turntable 41 is held by a latch 46 which falls into a detent 47 of the base plate 45. The latch 46 can be unlatched by pressing on a plunger 48. The pressing rod 48 is guided in a drive rim 49. The drive rim 49 serves to turn turntable 41 by means of a special driving device. A horizontally disposed sliver-separating rod 50 is connected to the turntable 41 by a rod 51 and guides the slivers 52, 53 so that, when the turntable 41 is turned through 90° clockwise or counterclockwise i.e. rightwards or leftwards, out of the middle position thereof, an undue mutual engagement of the slivers is avoided. It is apparent that the sliver 52 coming out of the sliver can 42 is fed through the sliver feeding device 24 to the spinning station 23.

Evident, moreover, in FIG. 1 is a can exchange device 54 which is combined with a joining or piecing device 55. This combined device 55 is guided by drive rollers 56 which are supported on the rail 39 and by support rollers 57 which are braced against the rail 40.

Only the essential parts of the conventional joining device 55 are shown in FIG. 1. Readily recognizable therein, for example, is a coil drive 58 that is fastened to a swivel arm 59 and is placed against the take-up coil 34 when thread-rejoining is to occur after a thread break. This placement of the coil drive 58 against the take-up coil 34 takes place for the purpose of driving the take-up coil 34 in reverse direction. A suction nozzle 60 sucks in the thread end of the take-up coil 34. A pivoted delivery arm 61 brings the sucked-in thread end during the joining operation to the withdrawal tube 28 through which it is sucked into the spinning rotor 26. A demand sensor 26 receives a signal from a transmitter 63 of the spinning station 23 if a thread break exists at this spinning station.

The support tube 38 serves simultaneously as a suction channel. The joining device 55 has a suction connection 64. The correct position at a spinning station necessary for a joining operation and also for a can exchanging operation is attained by the combined can exchanging and joining device 54, 55 by means of the engagement of a latch 65 into a detent 66 which is fastened to the rail 39. Electrified rails 67 are mounted on the support tube 38 and supply power through current collectors 68 to the traveling device. Under the support tube 38 are cams 69, 70, 71 which are disposed opposite sensors 72, 73, 74 on the traveling device 54, 55. As explained hereinafter, the arrangement of the cams produces a coding which is read by the sensors. As the can exchange device 54, a manipulator 75 for manipulating filled sliver cans is provided as a means programmable for the exchange operation. The manipulator 75 is formed of a full-can and an empty-can manipulator as explained hereinafter. In FIG. 1, the manipulator 75, in fact, holds a filled sliver can 76 is ready condition. With this held-ready sliver can 76, the combined exchanging and joining device 54, 55 travels continuously past the spinning stations of the operating range thereof. The sliver end 77 is held ready in a clamp 78 of a swivel arm 79. A tie rod 80 is shiftably connected to the swivel arm 79, which can assume various positions. If the swivel arm 79 is swung upwardly about 60° clockwise, it assumes a position wherein it can insert the sliver end 77 into the sliver feeding device 24.

This position is indicated in phantom at 79*a* in FIG. 1. In this position of the swivel arm 79, the tie rod 80 is simultaneously hooked into a fork 81 of the sliver-feeding device 24. The tie rod 80 is guided by a pin 82 of the swivel arm 79, and moreover also by a pin 83 at a lever 84 which lies, in neutral position thereof, coaxially to the pivot point of the swivel arm 79. The lever 84 is pivoted about a pivot 85 thereof. When the pin 86 of the tie rod 80 has hooked into the fork 81, the drawer-shaped sliver-feeding device 24 can be pulled out by swinging the lever 84 counterclockwise so that the clamp 78, as shown in FIG. 1, is disposed above the sliver-feeding device 24. The sliver-feeding device 24 is shown in greater detail in FIGS. 8*a*, 8*b*, 9*a* and 9*b* and will be further described hereinafter.

The swivel arm 79 can also swing outwardly from the initial position thereof about 20° counterclockwise. The corresponding position 79*b* of the swivel arm 79 is shown in phantom in FIG. 1, and respective position 80*b* of the tie rod 80 is similarly shown in phantom in the figure. In these positions of the swivel arms and the tie rod, the sliver can 76 can be transported unhindered in longitudinal direction of the spinning machine.

Additionally shown in FIG. 1 is a movable device 87 for measuring the fullness condition of the can. The measuring device 87 is pivoted about a pivot shaft 88 and carries a sensor 89 at its free end. As an example in the sliver can 43, there is shown in broken lines a spring base plate 90 present in most conventional cans which is located in the upper region of the can when it is nearly empty. This spring base 90, which is moved upwardly by a spring 91 concurrently with the withdrawal of sliver from the can, is usually made of metal so that a suitably constructed sensor can respond to this metal especially since the container or can wall is generally, as also in the instant case, formed of a non-metallic material. The dimensions of the can fullness measuring device 87 are such that the sensor 89 reacts when the sliver can is empty or nearly empty. The can-fullness measuring device 87 can be swung clockwise, until the sensor 89 thereof, as shown in phantom, engages the outer wall surface of the sliver can 43. In addition, the can-fullness measuring device 87 can be swung so far counterclockwise that it does not hinder transport along the spinning machine of a sliver can, such as the sliver can 76, for example.

Below the sliver can 76 suspended from the manipulator 75 is seen a drive 92 for the turntable 41. The drive 92 has a swivel arm 93 fastened to a tube 94 and carrying two rollers 96, 97 that are mutually connected by a drive belt 95. By pivoting the swivel arm 93, the roller 97 with the drive belt 95 can be placed against the drive rim 49 of the turntable 41. The plunger 48 is thus also pushed back and the latch 46 thereby unlatched. The tube 94 contains a shaft (non-illustrated in FIG. 1) for the drive 92. By means of this, the roller 96 is rotated, which drives the drive belt 95 and therewith also the roller 97 selectably toward the left-hand side (clockwise) or toward the right-hand side (counter-clockwise). A stop 98 is fastened on the swivel arm 93 in a manner that when the turntable 41 is turned back into its middle position shown, the latch 46 strikes against the stop 98 and, in this way, prevents further turning of the turntable 41. The turntable 41 can be turned through 90° selectably leftwards or rightwards, respectively, by means of the drive 92.

A reflex light gate 99 is mounted on the joining device 55 so that the light beam 100 thereof is reflected unattenuated by a reflector 101 mounted on the sliver-feeding device 24 only if no sliver runs into the sliver-feeding device 24. By means of this reflex light gate 99, the joining device 55 receives the information in advance, that, at the respective spinning station at which the sliver is missing, a can exchange is required before the joining operation. The reflex light gate 99 thus serves as a sliver sensor.

The spinning stations of the spinning machine are divided into spinning-station groups. Since, in the present embodiment example, four sliver cans stand on each turntable, each spinning-station group is formed of four individual spinning stations. It is apparent from FIGS. 2*a* to 2*d* that the spinning station 23 belongs to a spinning-station group which also includes the spinning stations 23*a*, 23*b* 23*c*. The turntable 41 with the sliver-separating rod 50 are readily noted under the spinning stations in FIGS. 2*a* to 2*d*. In FIGS. 2*b* and 2*c*, the turntable 41 is in the operating or initial position. The sliver cans 42 and 42*a* stand on the turntable in the rear row in the operation position of the turntable 41, and the sliver cans 43 and 43*a* in the front row. The sliver 52 of the sliver can 42 runs behind the sliver-separating rod 50 to the spinning station 23. The sliver 52*a* of the sliver can 42*a* runs also behind the separating rod 50 to the spinning station 23*c*. From FIG. 2*b*, it is apparent that the sliver can 43 has become empty.

From the sliver can 43*a*, the sliver 53*a* runs in front of the sliver-separating rod 50 to the spinning station 23*b*. It is apparent from FIG. 2*c* that the can 43*a* has become empty. The sliver 53 runs out of the sliver can 43 in front of the sliver-separating rod 50 to the spinning station 23*a*. In all other spinning-station groups of the spinning machine, the association of the sliver cans with the individual spinning stations and the sliver guidance is the same.

From FIG. 2*a*, it is apparent that no sliver runs into the spinning station 23. The can-exchange device 54, for the purpose of effecting a can exchange, has already clicked into position or come to a stop in front of the spinning station 23. The three dogs 69, 70, 71 of the spinning station 23 (note FIG. 1) signal to the sensors 72, 73, 74 that the sliver can 42 here, which is associated with the spinning station 23, must be exchanged. Through the activation of all three sensors, the corresponding exchange program of the can-exchanging device 54 is selected. Since the sliver can 42 stands in operating position in the rear row (note FIG. 2*b*) the turntable 41, in order to effect the exchange operation, must be rotated counterclockwise through 90°, a phase that has already been reached in FIG. 2*a*. Controlled by the selected program, the drive 92*a* has already been placed in engagement with the drive rim 49 of the turntable 41 and, through the running drive belt 95*a* thereof, the turntable 41 has been rotated into the exchange position. During the rotation of the turntable 41, the sliver separating rod 5 supports the sliver 53.

In FIGS. 2*a* to 2*d*, the second drive 92 with the tube 94 and the roller 97 thereof is shown on the merely diagrammatically represented can-exchange device 54. The details of the can exchanging operation will be explained in detail hereinafter.

From FIG. 2*b*, it is seen that no sliver runs out of the sliver can 43 into the spinning station 23*a* any more. The can-exchanging device 54 has already come to a stop in front of the spinning station 23*a*. This spinning station 23*a* has only two dogs so that, in this case, only the sensors 72 and 74 of the can-exchanging selected there. The turntable 41 need not be turned to exchange the sliver can 43.

From FIG 2*c* it is noted that no sliver runs out of the sliver can 43*a* into the spinning station 23*b*. Also here, turning of the turntable 41 is unnecessary for exchanging the silver can 43*a*. The spinning station 23*b* has also only two dogs so that, in this case, the sensors 72 and 73 for the appropriate exchange program are activated.

According to FIG. 2*d*, the sliver can 42*a* has become empty so that the spinning station 23*c* receives no more sliver. The can-exchanging device 54 has already stopped in front of the spinning station 23*c*. This spinning station 23*c* has only a single dog so that only the sensor 73 is activated. The program selected through the sensor 73 has already begun to run. The drive 92 has already turned the turntable 41 clockwise through 90° so that the sliver can 42*a* is also already disposed in the exchange position. The sliver-separating rod 50 supports the sliver 53*a* coming out of the sliver can 43*a* during the exchange operation.

It can already be recognized from FIGS. 2*a* to 2*d* that, for the movement of the turntable drives and the manipulators (not illustrated therein) which are to effect the can exchange, various course and paths are necessary, depending on the spinning station of a spinning-station group as which the can exchanging device 54 must operate. four different programs are therefore necessary for the exchange operation in the embodiment example of the invention. It is apparent from FIGS. 2*a* to 2*d* that the filled sliver can 76 is always disposed on the right-hand side of the can-exchanging device 54. The disposition of the manipulators thereby of necessity results therefrom, as will be described in greater detail hereinafter with reference to FIGS. 3 to 7.

Figure 3:
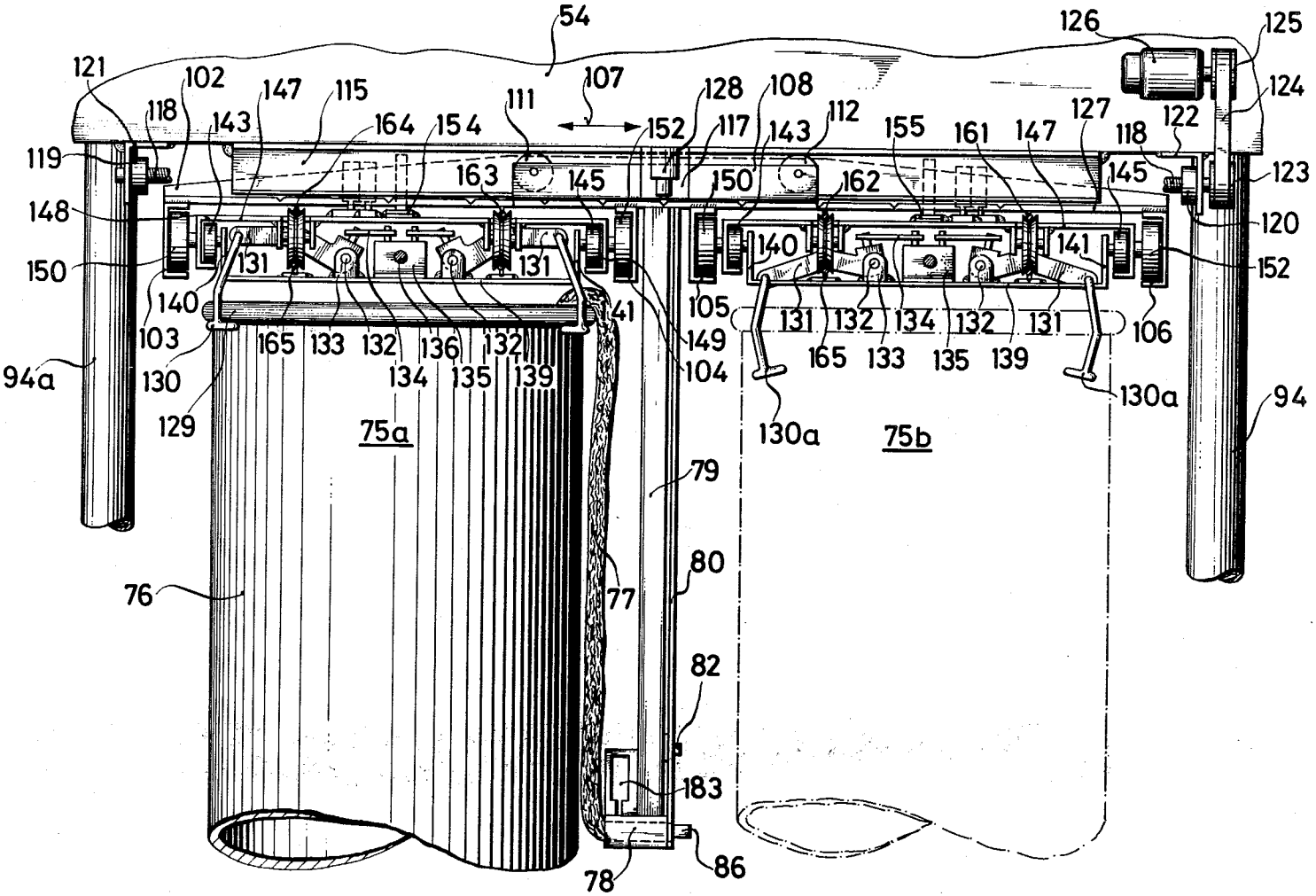
FIG. 3 is a rear view of the manipulators.

In the rear view of FIG. 3, part of the can-exchange device 54 with the tubes 94, 94*a* is readily apparent. Also shown are a full-can manipulator 75*b*. The manipulators are carried by a manipulator carrier 102. For this purpose, the manipulator carrier 102 has traverses 103 to 106. The manipulator carrier 102 can itself be driven in the longitudinal direction of the machine as representated by the double-headed arrow 107. For this purpose, the manipulator carrier 102 has a two-part undercarriage 108 with profiled rails 109, 110 on which rollers 111 to 114 are mounted (note also FIG. 4). The rollers 111 to 114 can be moved on profiled rails 115, 116 that are fastened to the underside of the can-exchanging device 54 (note also FIG. 1).

Figure 4:
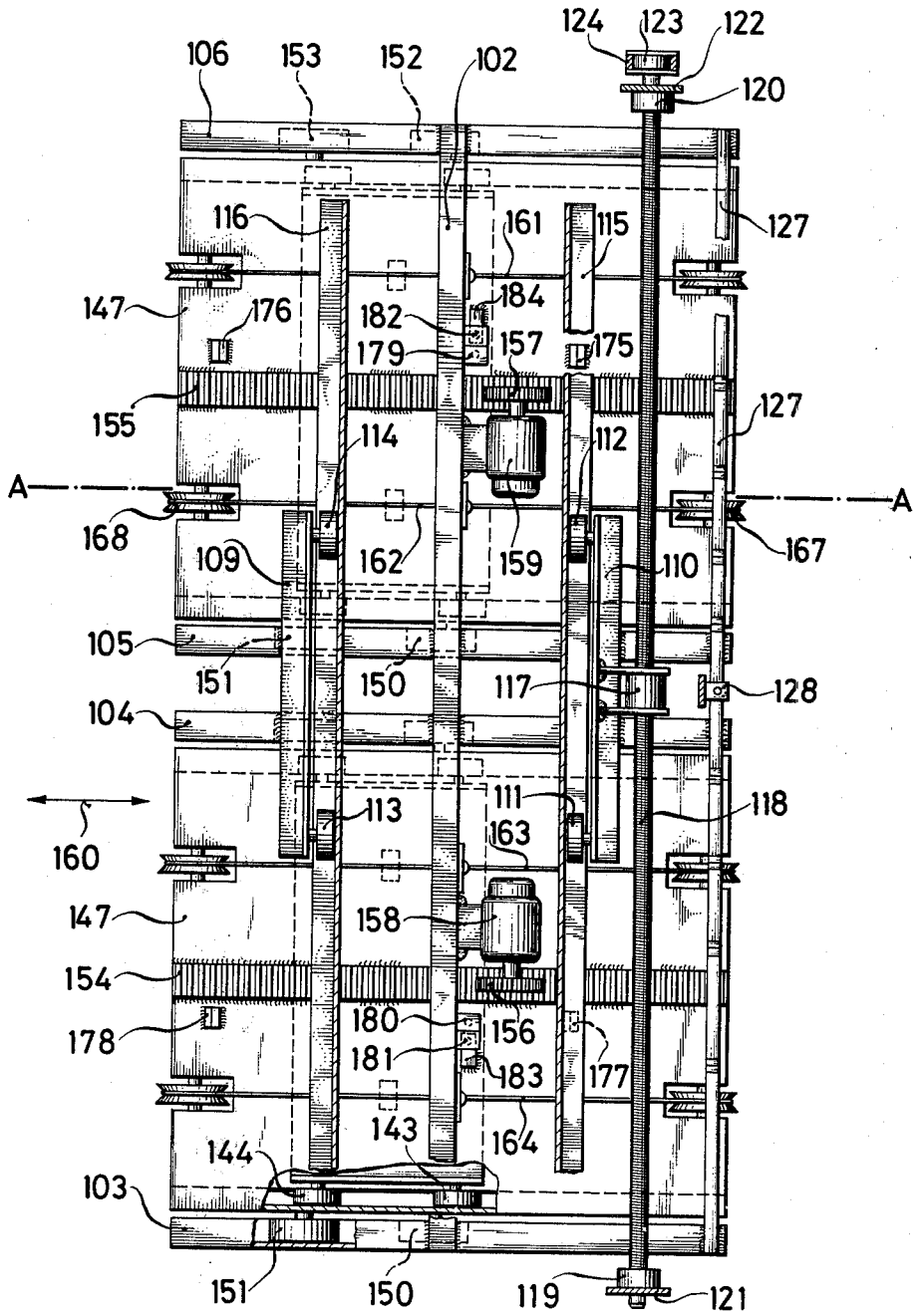
FIG. 4 is a top plan view of the manipulators.

From FIG. 4, it is apparent that a fixed spindle nut 117 is connected to the profiled rail 110. By means of a spindle 118, the spindle nut 117 and therewith the manipulator carrier 102 with all the parts thereof can be moved in the longitudinal direction of the spinning machine. For this purpose, the spindle 118 with the bearings 119, 120 thereof is rotatably mounted on traverses 121, 122 that are connected to the can exchanging device 54. A belt pulley 123 is located at the one end of the spindle 118 and is connected by a serrated belt 124 to a belt pulley 125 of a drive motor 126. (Note also FIG. 1).

The spindle 118 is so constructed that the thread thereof is self-locking so that when the drive motor 126 is stopped, it is not possible to shift the manipulator carrier 102.

A switch rail 127 provided with notches is fastened to the transverses of the manipulator carrier 102. The switch rail 127 cooperates with a roller switch 128 which is fastened to the can-exchange device 54. The switch rail 127 has a notch for each stop position of the manipulator carrier 102 and for the middle position of the carrier. As will be explained hereinafter in greater detail, the control program is constructed so that for each movement of the manipulator carrier 102, a number of switching pulses of the roller switch 128 are pre-set. From the pre-set number of the switching pulses of this switch, the stop position for the manipulator carrier is then obtained.

The full-can manipulator 75*a* and the empty-can manipulator 75*b* are of fully identical construction. Corresponding parts thereof are therefore identified by like reference numerals. Construction and operation of the manipulators will be described hereinafter with respect to the full-can manipulator 75*a*. The manipulator can lift a sliver can, the sliver can 76 in the embodiment of the invention, can move it forward and backward in transverse direction of the machine, and lower it again. To lift and hold fast the sliver cans, use is made of the fact that the cans are normally provided with a bead-like edge 129. Stirrups 130 are provided which are articulatedly suspended in support levers 131 as also shown especially in FIGs. 6 and 7. Each support lever 131 is fastened to a shaft 132 which is rotatable in bearings 133. The support levers 131 can execute a swinging movement about the central axis of the shaft 132. This is made possible by a strap 134 which, respectively, connects the support lever 131 articulated to a spindle nut 135.

The spindle nut is secured against rotation and can be shifted by a spindle 136 in the direction represented by the double-headed arrow 137 (FIG. 6). A motor 138 provides a drive for the spindle 136. When the spindle nut 135 is in the position shown in FIG. 6, the support levers 131 are swung upwardly, whereby the stirrups 130 which have placed themselves due to their own weight under the edge 129 of the sliver can 76 have been lifted together with the sliver can 76. The stirrups 130 of the empty-can manipulator 75*b* have become lowered in order to be able to take up an empty sliver can in this position.

Each manipulator has a telescoped chassis formed of a base plate 139 with side walls 140, 141 to which rollers 142 and 145 are fastened, as shown especially clearly in FIG. 6. The bearings 133, the motor 138 and a spindle bearing 146 are also fastened to this base plate 139. The entire mechanism for actuating the stirrups 130 is thus fastened to the base plate 139.

The base plate 139 with the side walls 140, 141 and rollers thereof and with the actuating mechanism for the stirrups 130 is covered by telescopically shiftable cover plate 147. The cover plate 147 has two side walls 148, 149, the ends of which are inwardly flanged and serve as supports for the rollers 142 to 145 of the base plate 139. At the outside of the side walls 148, 149, the cover plate 147 also carries four rollers 150 to 153 which are rollable transversely to the longitudinal direction of the spinning machine, in the case of the full-can manipulator 75*a*, in the traverses 103 and 104 and, in the case of the empty-can manipulator 75*b*, in the traverses 105 and 106 of the manipulator carrier 102.

Above the cover plate 147 of the full-can manipulator 75*a*, there is provided a rack 154, and above the cover plate 147 of the empty-can manipulator 75*b* a rack 155. The gear 156 of a motor 158 meshes with the rack 154 and the gear 157 of a motor 159 with the rack 155. As is apparent from FIG. 4, the racks 154 and 155 and therewith also the cover plates 147 can travel back and forth in direction represented by the double-headed arrow 160 with the aid of the motors 158 and 159. The rollers 150 to 153, as hereinaforementioned, roll on the traverses of the manipulator carrier 102.

So that upon the movement of the cover plates 147 in the same direction at double velocity, the base plate 139 can also be moved, cables 161 to 164 are fastened to the manipulator carrier 102. Each cable is slung around two pulleys that are fastened to the cover plates 147. Respective cable clamps 165 are provided on the base plate 139 and connect the lower run of the cable to the base plate 139. The disposition and function of the towing cable construction is especially clearly shown in FIGS. 5*a* to 5*c*. FIG. 5*a* shows the can-exchange device 54, on the underside of which the profile or section rails 115 and 116 are fastened. From the under carriage 108 of the manipulator carrier 102, the profile or section rails 109 and 110 with the rollers 112 and 114 fastened thereto are clearly seen. Further shown are the spindle 118 and the spindle nut 117 as well as the motor 158 with the gear 156 thereof.

Since FIG. 5*a* shows the embodiment of the invention in fractional view taken along the line A–A in FIG. 4, there is also clearly shown therein the cover plate 147 with the side wall 148 belonging to the empty-can manipulator 75*b*. In the rear there is likewise yet seen the traverse 105 of the manipulator carrier 102. The rollers 150 and 151 fastened to the side wall 148 are represented as nonvisible members by broken lines in FIG. 5*a*. Also seen in FIG. 5*a* is the base plate 139 belonging to the empty-can manipulator 75*b* with the side wall 140 to which rollers 143 and 144 are fastened. At the base plate 139 are seen the cable clip 165 and at the manipulator carrier 102, the cable clip 166. Also seen are two pulleys 167 and 168, the shafts 169 and 170 of which are mounted in respective journal bearings 171 and 172. The journal bearings 171 and 172 are covered by te pulleys 167 and 168 and are therefore represented by FIG. 5*a* in broken lines as non-visible parts. The cable 162 visible in FIG. 5*a* extends from the clip 166 over the pulley 167, the clip 165 and the pulley 168 back to the clip 166.

Below the described arrangement, there is visible, in a broken-away view, a stirrup 130 and the sliver can 76 suspended from the stirrup 130 as well as the tube 94*a*.

If, in accordance with FIG. 5*b*, the cover plate 147 now is moved in direction of the arrow 173 up to the illustrated end position of the rollers 150, 151, the rollers 143, 144 due to the cable or rope transmission traverse a travel distance twice as long, whereby they roll on the flange-edge of the side wall 148. If the cover plate 147, according to FIG. 5*c*, is moved in the reverse direction, namely in direction of the arrow 174, the base plate 139, because of the cable transmission, likewise traverses a distance in this direction that is twice as long. FIG. 5*c* shows the end position assumed by the base plate 139 when it has traveled in direction of the arrow 174.

In FIG. 4 there are shown adjacent the rack 155, two control dogs 175 and 176 and, adjacent the rack 154, two control dogs 177 and 178. The control dogs are so disposed that they act upon end switches when the cover plates 147 have traveled in direction of the double-headed arrow 160. The control dogs 175 and 176 act upon the end switch 179, and the control dogs 177 and 178 on the end switch 180. The end switches 179 and 180 are connected into the control circuit of the motors 158 and 159 so that the motors are switched off when the end positions of the cover plates have been reached.

There are furthermore shown in FIG. 4, two roller switches 181 and 182 which, at the instant illustrated, are located above control dogs 183 and 184, respectively, which signal the middle position or original position of the cover plates 147.

As shown in FIG. 3, the sliver end 77 projection out of the sliver can 76 is held by a clamp 78 of the swivel arm 79. Also visible in FIG. 4 especially clearly is a control or switching magnet 183 for opening and closing the clamp 78. Further details thereof are shown in FIGS. 8*a*, 8*b*, and 9*a* and 9*b*.

Figure 8B:
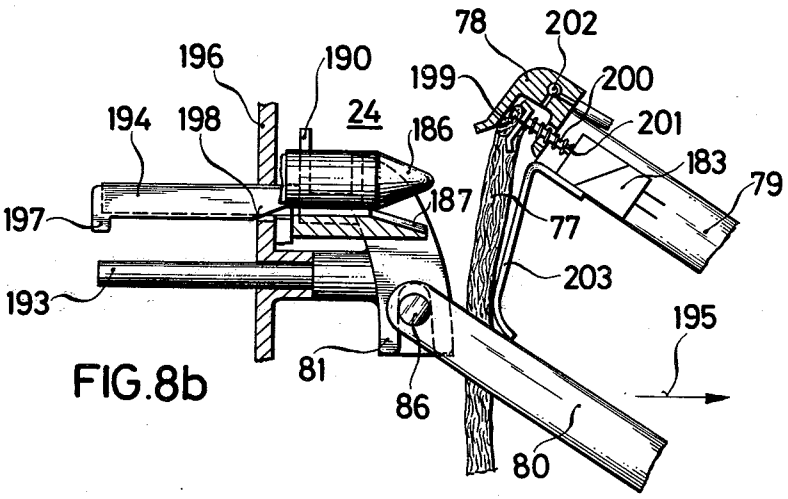
Figure 9B:
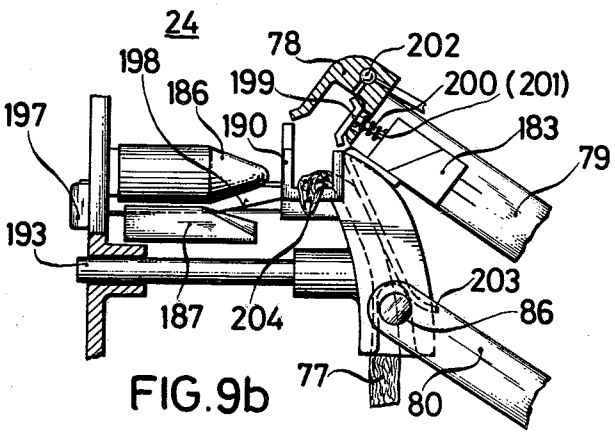
Figure 8A:
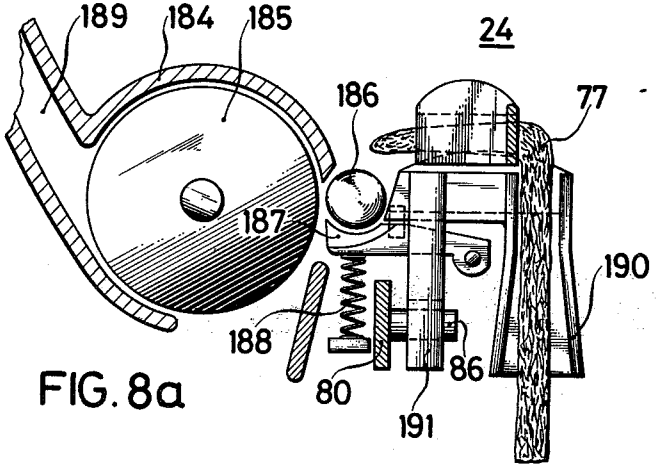
Figure 9A:
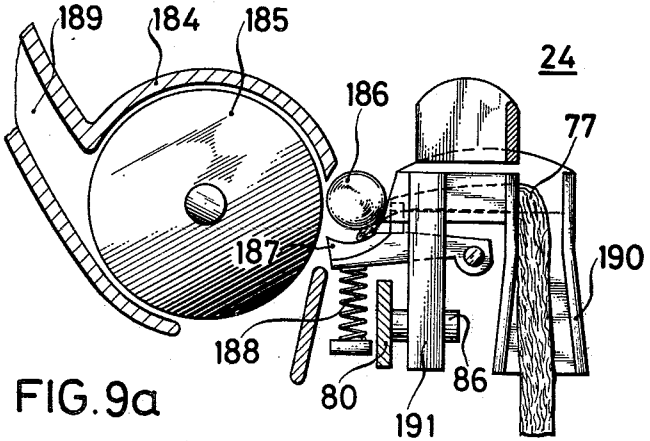

In the sectional views of FIGS. 8*a* and 9*a*, there are shown in a cross section the sliver loosening device 184 of a spinning station with the loosening roller 185, the feed roller 186 and the clamping table 187 which can be pressed by a spring 188 against the feed roller 186, whereby the sliver is to be fed between the clamping table 187 and the feed roller 186 to the loosening roller 185. The loosening roller 185 and the feed roller 186 have separate drives. Through the rotation thereof, which is adjusted one to the other, the fed sliver is loosened or broken up into individual fibers and fed through the fiber channel 189 to the spinning rotor.

The sliver feeding device 24 disposed in front of the fiber loosening device 184 has a funnel-shaped sliver channel 190. The latter has an actuating lever 191 with a fork 81 into which the pin 86 of the tie rod 80 can engage during the pivoting movement thereof (note also FIG. 1 and FIG. 8*b* or 9*b*). The actuating lever 191 is provided with a guide rod 193 and the sliver channel 190 with a guide rod 194. Through moving the engaged tie rod 80 in direction of the arrow 195 (FIG. 8*b*), the sliver-feeding device 24 can be drawn out of the operating position thereof shown in FIG. 8*b* into the filling position thereof shown in FIG. 9*b*. The guide rods 193 and 194 are guided in the housing wall 196 of the spinning station. A projection 197 prevents the complete withdrawal of the sliver feeding device 24 out of its guide.

There is seen in FIGS. 8*b* and 9*b* that the guide rod 194 has a bevel 198. When withdrawing the sliver feeding device 24 into the filling position, this bevel 198 runs onto the clamping table 187 and presses it down so that it is open with respect to the feed roller 186 for taking up the sliver end 77.

In FIG. 8*b*, there is shown that the sliver end 77 is held in the clamp 78 of the swivel arm 79 by a clamping surface 199 which is fastened at the end of a control or switching plunger or armature 200 of a control or switching magnet 183. Through the action of a compression spring 201, the silver end 77 is clamped between the clamp 78 and the clamping surface 199. If the clamp 78 is to be opened for releasing the sliver end, this is brought about by the switching magnet 183. The instant the switching magnet 183 has pulled back the plunger 200, the sliver end is released. The release occurs only if the tie rod 80 has withdrawn the sliver feeding device 24, so that the sliver channel 190 is located under the clamp 78. FIG. 9*b* illustrates the instant that the sliver end 77 is transferred to the sliver channel 190. The transfer of the sliver end can be assisted by compressed air through a compressed air channel 202. In order to prevent the sliver end 77 from slipping out of sliver channel 190, as long as the sliver channel 190 has not yet returned to the operating position thereof, a leaf spring 203 provided on the swivel arm 79 clamps the sliver end tightly in the sliver channel 190. During the shifting back of the sliver feeding device 24 by the tie rod 80 into the operating position, the point 204 of the sliver end 77 slides between the conically terminating feed roller 186 and the beveled clamping table 187. Since the clamping table 187 engages the feed roller 186 only at the last part of the return movement of the sliver channel 190, the sliver end 77 has already been slid-in so far that during the engagement of the clamping table 187, it is then securely clamped. If the feed roller 186 is then driven, the sliver is drawn into the fiber loosening device 184 with certainty.

In FIG. 10, there is shown the device of FIG. 1 in front elevational view, partly in section. Readily seen therein are, for example, the rail 39, the support tube 38, the rollers 56, the swivel arm 59, the coil drive 58, the suction nozzle 60 and the rail 40. On the left-hand side of the can-exchange device 54, the control and drive mechanism of the drive 92 for the turntable are shown in a housing 205. The tube 94 is fastened to the housing. In the interior is a swivel tube 206 to which the swivel arm 93 is fastened below. At the upper end of the swivel tube 206, a gear segment 207 is located, meshing with the pinion 208 of a motor 209. By turning the gear segment 207, the swivel arm 93 with the rollers 96 and 97 fastened thereto and with the drive belt 95 according to FIG. 1 can engage the drive rim 49 of a turntable or be lifted therefrom. At the gear segment 207, there is a switching vane 210 which can act upon the end switches 211 and 212 disposed offset from one another, the end switches 211 and 212 being connected into the control circuit of the motor 209 in a manner that travel beyond the end positions of the swivel arm 93 is impossible.

A shaft 213, to the lower end of which the roller 96 is fastened, is centrally mounted in the swivel tube 206. The shaft 213 carries a gear 214 at the upper end thereof, the gear 214 meshing with the pinion 215 of a motor 216.

On the right-hand side of FIG. 10, there is another drive 92*a* having the same parts as the drive 92 but being constructed as a mirror-image thereof. Like parts bear the same reference numerals with the addition of the subscript a, however. Motors and upper transmission parts of the drive 92*a* are built into a housing 217 which also contains the drive for the can-fullness measuring device 87 which is formed of a shaft 218, a worm gear 219 fastened thereto and a motor 220 with a worm 221. The shaft 218 carries two cam discs 222 and 223 which act upon a switch 224 and an electric slide rheostat 225. Through the switch 224, the end positions of the can-fullness measuring device 87 are signaled and through the slide rheostat 225, the switch positions are signaled.

The swivel arm 79, to which the clamp 78 for the sliver end 77 is fastened, can be swung by means of a shaft 226 into the region indicated in FIG. 1. The shaft 226 is guided in a bearing bushing 227 connected to the housing 217 and carries a worm gear 228 at the end thereof. The worm gear 228 is driven by a worm 230 located at the motor 229. Two cam discs 231 and 232 are fastened to the shaft and act upon a switch 233 and an electrical slide rheostat 234. The switch 233 signals the end positions, and the slide rheostat 234 the position of the swivel arm 79.

Also the tie rod 80, which is articulatingly connected to the lever 84 has its own drive. The lever 84 is connected to a shaft 235 at the end of which a worm gear 236 is mounted. The worm gear 236 meshes with a worm 237 which is driven by a motor 238. Also, the shaft 235 carries two cam discs 239, 240. The cam disc 239 acts upon a switch 241, and the cam disc 240 acts upon an electrical slide rheostat 242. The switch 241 signals the end positions, and the slide rheostat 242 the respective switch position of the lever 84.

From FIG. 10, it is seen that every individual displacement element of the can-exchange device 54 has its own motor so that, for each displacement element, the movement cycles can be electrically controlled individually.

From FIG. 11 it is noted that at the end of the otherwise not-illustrated rotor spinning machine 21, the rail 39 and the rail 40 form circular track. The can-exchanging device 54 can be driven with the aid of the drive rollers 56 and support rollers 57 thereof in circulating travel from the one to the other side of the spinning machine. FIG. 11 also shows that the can-exchanging device 54 has stopped at the middle of the circular arc in order to release an empty sliver can 244 to a loading station 243, and to pick up a filled sliver can 245. The loading station 243 is shown only diagrammatically in FIG. 11. On the left-hand side of the figure is a roller base formed of a multiplicity of transport rollers 246 on which eleven filled sliver cans 245*a* stand. The sliver ends 247 thereof are held by a shifting device 248 regarding which further details will be given hereinafter.

On the right-hand side of FIG. 11 is a roller base with a multiplicity of relatively longer transport rollers 249 and relatively shorter transport rollers 250. The transport rollers 250 carry gears 251 at the right-hand ends thereof, as viewed in FIG. 11. The foremost longer roller 249*a* also has a gear 252. All of the gears are connected to one another by an endless chain 253. Since the shorter transport rollers 250 do not have their own drive, they are driven in this manner by the foremost longer roller 249. A further description of the roller drive as such will be provided hereinafter. In the middle front and engaging the can-exchanging device 54 is a movable transport device 254 which is equipped with transport rollers 255 for the transport of filled sliver cans, and transport rollers 256 for the transport of empty sliver cans. Also the transport device 254 will be discussed in further detail, hereinafter. At the right-hand side rear, there are two empty sliver cans 257 and 257*a* that have already been deposited.

In FIG. 11, details of the loading station 243 had not been illustrated, but they will now be discussed in detail with respect to FIGS. 12 to 14. FIG. 12 is an elevational view of the loading station 243 as seen from the spinning-machine side, FIG. 13 is a partial sectional view of the loading station, likewise seen from the spinning-machine side, and FIG. 14 is a partial elevational view of the loading station 243 as seen from the side, and also partly cut away, to show details.

In FIG. 12 there are shown a left-hand side wall 258, a right-hand side wall 259, middle walls 260 and 261 and a framework 262. Of the roller track for filled sliver cans, one can see the foremost short transport roller 263 which is mounted in the left-hand side wall 258 and in a continuous profiled rail 266. Of the roller track for empty sliver cans, one can likewise see only the foremost short transport roller 265, which is mounted in the right-hand side wall 259 and a continuous profiled rail 266.

One can see in FIG. 12, sliver cans that are standing in four rows adjacent one another, and specifically, both inner can rows 268 and 269 and both outer can rows 270 and 271. Of these can rows, only those sliver cans 272, 273, 274 and 275 standing in front, respectively, are visible in FIG. 12. Under the inner can rows 268 and 269 is seen, in front, the transport device 254 equipped with transport rollers 255 and 256. The transport rollers 255 are mounted in the left-hand side wall 276 of the transport device and in a middle framework 278.

The transport rollers 256 are mounted in the right-hand side wall 277 of the transport device and in a middle framework 278. The transport device 254 is capable of traveling by means of drive rollers 279 on the profile or section rail 264, by means of drive rollers 280 on the profile or section rail 266 and by means of centrally disposed drive rollers 281 on a central guide rail 282. The two sides of the middle framework 278 are connected to one another by a wall 283, to which, from the rear, a spindle nut 284 is fastened so that the entire platform 254 can be driven back and forth by turning a spindle 285.

At the left-hand side wall 258 of the loading station 243 is a stop plate 286 for the sliver can 272, and at the right-hand side wall 259, a stop plate 287 for the sliver can 275.

Indicator switches 288 and 289 are visible, respectively, over the stop plates 286 and 287. The indicator switch 288 signals the presence of a sliver can in the foremost position of the can row 270, and the indicator switch 289 the presence of a sliver can in the foremost position of the can row 271. Behind the transport roller 263, a slider or shifter 290 is visible, and behind the transport roller 256 a slider or shifter 291. Both shifters 290 and 291 are commonly driven and serve to shift the front can of the can row 270 into the can row 268, and the front can of the can row 269 into the can row 271. Further details will be described hereinafter with respect to FIG. 13.

The position of the shifters 290 and 291 is monitored also by indicator switches. An indicator switch 292 at the side wall 258 gives a signal when both shifters 290 and 291 are located in the left-hand end position, and at the top plate 287, another indicator switch 293 is located which signals when both shifters 290 and 291 are located in the right-hand end position.

In the upper part of the middle wall 260, 261 bearings 294, 295 are visible which serve to support a shaft 296 which carries two large sprocket wheels 297 and 298 and a small sprocket wheel 299. Behind the large sprocket wheels 297, 298 and above the shaft 296, as viewed in FIG. 12, another shaft 300 is visible which carries a small sprocket wheel 301 and is mounted in bearings 302 and 303. These bearings 302 and 303 are seated also on the middle walls 260 and 261. The small sprocket wheels 299 and 301 are mutually connected by an endless chain 304. The shaft 300 has another bearing 305 at the framework 262. At the free end of the shaft 300, yet another sprocket wheel 306 is mounted which is connected by an endless chain 307 to a sprocket wheel 308 of a transmission 309 that is provided with a drive motor 310.

On the large sprocket wheels 297 and 298, there are noticeable in the sectioned part of FIG. 12, respective link-belts or chains 311 and 312. The link-belts 311 and 312 carry sliver clamps for the sliver ends 315 and 316 projecting out of the respective sliver cans 272 and 273. The sliver clamps or clips 313, 314, 317 and 318 are clearly seen in FIG. 12. The function and operation of the parts shown in FIG. 12 will be described in greater detail hereinbelow with respect to FIG. 14.

In FIG. 13 additional bearings 319 and 320 in which a shaft 321 is mounted are provided on the middle walls 260 and 261. Two pulleys 322 and 323 are fastened to the shaft 321. Another bearing 324 is fastened to the framework 262. At the end of the shaft 321, there is located a sprocket wheel 325, which is connected by an endless chain 326 to a sprocket wheel 327 of a transmission 328 belonging to a drive motor 329. An endless belt 330 is slung around pulley 322 and is reversed by a belt pulley 332 loosely rotatable on a shaft 331 and guided over a number of pressure rollers which serve for driving the longer transport rollers 246. One of these pressure rollers is visible and is designated with the numeral 334.

Another belt 336 is slung around the pulley 323 and extends crossed-over to a pulley 333 where it is reversed and guided over pressure rollers which serve to drive the longer transport rollers 249.

In FIG. 13, only the pressure roller 335 is visible. The pressure rollers 334 and 335 rotate freely on a shaft 337 which is fastened to the middle walls 260, 261.

The can rows 268, 269, 270 and 271 are again seen in FIG. 13. In these can rows, the sliver cans 338, 339, 341 are visible. Sliver ends 342 and 343, respectively, extend out of the sliver cans 338 and 339 to the sliver clamps or clips 344, 345 fastened to the link chains 311 and 312. In the foreground, a spindle 346 is shown mounted in the side walls 258 and 259, a sprocket wheel 347 being at an end thereof. The sprocket wheel 347 is connected by an endless chain 348 to the sprocket wheel 349 of a motor 350. The shifters 290 and 291 have an internal or nut thread accomodating the thread of the spindle 346. When the spindle 346 rotates, the shifters 290 and 291 can be made to travel toward the right-hand side and back again.

Through the cross-over of the belt 336, the transport rollers 246 can be driven clockwise and the transport rollers 24 counterclockwise by means of one and the same drive motor 329.

FIG. 14 shows the loading station 243 from the side, several parts thereof being shown in section. Readily seen are the middle wall 261, the framework 262, the sprocket wheel 298, the belts 330 and 336, the pulley 333 with another pulley 333a, the disposition of the transport rollers 249, the disposition of the transport rollers 256 as parts of the transport device 254, the spindle 346 and the drive motors 310 and 329.

The spindle 285 has at an end thereof, hidden by the middle wall 261, a gear 351 with which another gear 352 meshes which is seated on a drive shaft of a motor 353.

Behind the middle wall 261, one can see a sliver can 354 which is already standing on the transporting device 254 and hides two further sliver cans 355 and 356.

The combined can-exchanging and joining device 54, 55 has stopped in front of the loading station 243. It is apparent that the manipulator 75 can pass to the position 75c thereof, and the transport device 254 to the position 254a thereof. If the transport device has advanced into the position 254a thereof, the sliver can 354 stands at the same time in the position 254a and can be taken up by the manipulator 75 in this position.

The manipulator 75 has, however, already loaded a can, in fact, the sliver can 76. The end positions of the transport device 254 are signaled by two end switches, the end switch 357 signaling the end position in the outwardly traveled and the end switch 358, the end position in the inwardly traveled condition.

It is apparent in FIG. 14 that the swivel arm 79 can swing along a circular arc 359 to the level of the sprocket wheel 298. The instant, for example, the sliver end 361 of the sliver can 354 found in the sliver clip 360 has traveled farther in direction of the arrow 362 by one clamping division, the vane 363 of the clip or clamp strikes against a stop 364, so that the clamp or clip opens and releases the sliver end. At this instant, the swivel arm 79 with the clip or clamp thereof is located in front of the opening sliver clamp or clip of the link chain 312 and takes over the sliver end. In the interim, the tie rod 80 is withdrawn due to the swing of the lever 84 into the position 84a so that the transfer operation cannot be disturbed by the tie rod 80. The drive motor 310 switches the sprocket wheel 298 and also the sprocket wheel 297 located therebehind, and therefore not visible in FIG. 14, respectively, one clamping division forwards. This clamping division i.e. the spacing between clamps or clips, corresponds to half the center spacing of the sliver cans.

A sensor 366 is located on an arm 365 of the framework 262. Opposite the sensor 366, a transmitter 367 is disposed on the framework of the combined can-exchanging and thread-joining device 54, 55. A control link is thereby formed between the can-exchanging device 54 and the loading station 243. The sensor 355 can, for example, be a proximity switch and the transmitter 367 a metal vane. The respectively correct position of the sliver clamps or clips of the link belts or chains 311 and 312 is monitored by a position indicating switch 368.

The drive motors 310 and 329 are controlled stepwise. The switching step for the drive motor 329 is so made that the filled sliver cans are transported in direction of the arrow 369 and the empty sliver cans opposite the direction of the arrow 369 by one respective center spacing. The switching step of the drive motor 310 is made so that the sliver clamps or clips of the link belts 311, 312 are moved respectively by one center spacing in direction of the arrow 362. Every second switching step of the drive motor 310, is followed by a switching step of the drive motor 329. In the switching pauses of the drive motor 329, respectively, a filled sliver can of the outer can row is transported to the inner can row, and an empty sliver can from the inner can row to the outer can row. Additional details of the step-switching are provided hereinbelow.

FIG. 15 is a diagrammatic top plan view of a sliver drawing mechanism 370 with can filling device 371 as well as a device 372 for holding the sliver ends 373, 374 and for transferring these sliver ends 373, 374 to the can-exchanging device 54.

It is further noted that also in FIG. 15, similar to the embodiment of FIG. 11, the rail 40 and the rail 39 extends in a circular arc from the one side of the spinning machine to the other.

Exactly on the central axis of the two-sided rotor spinning machine 21, the can-exchanging device 54 has stopped in front of the loading station 375. The can-exchanging device 54 has already delivered an empty sliver can 376 and has accepted a filled sliver can 377. In the loading station 375, there is a further empty sliver can 378, two additional filled sliver cans 379, 380, as well as a sliver can 381 that happens to be standing under the can-filled device 371 and is being filled up with sliver from the sliver drawing mechanism 370. Each time a filled sliver can has been surrendered to the can-exchanging device 54, an empty sliver can travels in direction of the arrow 382 under the can filling device 371. This can circuit is released only if the can filling device 371 has completely filled a sliver can, and no filled sliver can is disposed, as yet, in the delivery position.

Visible in FIG. 15 at the can filling device 371 is a swivel lever 383 on the end of which a clamping or clipping shears 384 is seated. After the can filling is terminated, the swivel lever 383 swings along the circular arc 385 in direction of the arrow 386, places the sliver end into the clamps or clips 387, 388 of the device 372 and severs the sliver. These operating steps can be effected automatically.

Details of the can transfer to the can exchanging device 54 and the surrender of empty sliver cans will not be described in detail herein. In principle, the transfer can be performed in a manner similar to that of the embodiment of FIG. 11. Because of the immediate filling, quite a small can supply is adequate in this embodiment. The feeding of the sliver occurs in front of the sliver drawing mechanism 370 out of large sliver cans 389. Six of such large cans 389 are seen in FIG. 15, the sliver thereof running as a bundle 390 into the sliver drawing mechanism 370.

As long as the large sliver cans 389 already contain adequately stretched sliver, the sliver drawing mechanism 370 can serve purely as a refilling station without stretching the sliver.

FIG. 16 shows a block diagram of a combined can-exchanging and joining device. When this device travels past a spinning station at which the sliver at the sliver feeding device 24 is missing, a switch 391 closes. The closing of this switch 391 is initiated by the reflex light gate device 99 (FIG. 1). If the switch 392 is simultaneously likewise closed, which is always the case if the can-exchanging device carries a filled sliver can in the full-can manipulator 75a (FIG. 3) thereof, the AND-condition is fulfilled at the AND-gate 393 so that a storage device 394 is set. With the setting of the storage device 394, a signal appears at the AND-gate 396 through the line 395. Since the spinning station is simultaneously in the thread break position because of the missing sliver, the demand switch 397 for the joining device is also closed so that at the AND-gate 396 likewise and the AND-condition is fulfilled and thereby the control logic 398 is switched on. The switching-on of the demand switch 397 is initiated by the demand sensor 62 (FIG. 1.).

In the control logic 398, the control commands of a program memory 399 and the signals of those switches are interlinked which provide the movement conditions and switch positions of the individual elements of the can-exchanging device. Via a trunk 400, the various motors and magnetic switches receive their control pulses or control current via amplifiers 401 to 414. The control is constructed as a sequential control: After every control step, an address counter 415 switches a step further and releases from the program storage 399 the corresponding commands. In the program storage device 399, five programs are stored. Four programs are required for the exchange operation at the spinning stations, because the can-exchanging device 54 can click into contact in front of a spinning station group according to FIGS. 2*a* to 2*d* in four different positions. A further program is necessary for the can-exchanging operation at the loading station. Through the setting of the switches 416, 417, and 418, the position of the can-exchanging device 54 in front of a spinning station group of four is signaled. The switch 416 is actuated by the sensor 72, the switch 417 by the sensor 73, and the switch 418 by the sensor 74 (FIGS. 2*a* to 2*d*). Depending upon the setting of the switches 416, 417 and 418, the corresponding program is selected by a connected program selector 419 and is communicated via a line 420 to the program storage device 399. The switch 421 is actuated by the sensor 89 of the can-fullness measuring device 87 (FIG. 1). If the sensor 89 has determined that the sliver can at the respective spinning station is not yet empty, a skip order is then given by the switch 421 over the line 422 into the program storage device 399 so that it jumps ahead so far in the program that the turntable on which the sliver can stands, is turned back to the operating position thereof.

Simultaneously, a pulse is transmitted over the line 423 and an OR-gate 424 through an amplifier 425 to an electromagnet 426. The electromagnet 426 acts by radio on a disturbance indicator lamp 427 which is installed at the respective disrupted spinning station. Through the lighting-up of the disturbance indicator lamp 427, the attention of the operating servicing personnel is drawn to the disturbed spinning station.

If a program for exchanging a sliver can has run so far that the sliver end of the sliver feeding device 24 is presented to the spinning station, the particular joining program is activated at the joining device 55 in a separate program storage 428, which is necessary so that, after a can-exchange, the spinning station may be again placed in operation. In a normal joining operation, the switch 391 is not closed because the sliver is present. On the other hand, the switch 397 is closed. The AND-condition is therefore fulfilled at the AND-gate 429 so that over the line 430, a separate program storage 431 has been selected for the normal joining program. A control logic 432 connected to the program memories 428 and 431 serves for controlling the joining device 55 which need not be described in any further detail. If for any reason the joining, after repeated attempts, if necessary, is not successful, the control logic 432 can initiate a trouble signal over the output line 433 at the respective spinning station.

In FIG. 17, the displacement diagrams for the five programs indicated with Roman numerals are illustrated. The displacement diagrams are to be read from left to right always starting from the zero portion: an upward deflection means "on", "forward" or "upward", a downward deflection means "off", "backward" or "downward".

Column I is associated with the can xchange in the position according to FIG. 2*a*, Column II according to FIG. 2*b*, Column III according to FIG. 2*c*, and Column IV according to FIG. 2*d*. Column V is associated with the can exchange at the loading station. The lines A to N are associated with the movements of the following parts:

Line A Manipulator carrier 102,
Line B Empty-can manipulator 75*b*
Line C Empty-can stirrup 130*a*,
Line D Full-can manipulator 75*a*
Line E Full-can stirrup 130,
Line F Drive 92*a* for turntable,
Line G Motor 216*a*,
Line H Drive 92 for turntable,
Line I Motor 216,
Line J Swivel arm 79,
Line K Clamp or clip 78,
Line L Tie rod 80,
Line M Can-fullness measuring device 87,
Line N On and Off switch of the loading station.

Program I operates as follows:

First, the drive 92*a* engages the drive rim 49 of the turntable (Line F). Then, the motor 216*a* is switched on. It runs until the turntable has turned through 90°. Then, the motor 216*a* is switched off again (Line G). Thereafter, the can-fullness measuring device 87 swings upwardly, against the sliver can to be exchanged and checks if it is full (Line M). It then swings immediately back beyond the neutral position thereof and to the back in order to provide displacement space for the can exchange. Then, the manipulator carrier 102 travels to the right-hand side so far that the empty-can manipulator 75*b* stands in front of the sliver can to be exchanged (Line A). In the interim, the empty-can manipulator 75*b* travels forward so as to take up the empty can (Line B). The empty can stirrups 130*a* are in neutral position in the interim i.e. they are in lowered condition. They shift themselves during the travel of the empty-can manipulator 75*b* over the empty sliver can that is to be taken up. The instant that has occurred, the stirrups 130*a* are driven upward whereby the can is automatically clamped and lifted upward (Line C). The empty-can manipulator 75*b* then travels back to the initial position thereof (Line B). Also, the manipulator carrier 102 travels back to the middle position thereof (Line A). Beforehand, the swivel arm 79 has traveled back in order not to hinder the exchange operation (Line J). After the empty can has been taken up, the swivel arm 79 swings outwardly beyond the neutral position thereof until it engages the sliver feeding device 24 (Line J). The tie rod 80 hooks thereby, quite by itself, into the fork 81 of the sliver feeding device 24. Then, the sliver-feeding device 24 is opened by the tie rod 80 (Line L.). When that has occurred, the clamp or clip 78 opens and transfers to the sliver channel 190 of the spinning station the sliver end of the filled sliver can that is yet to be transferred (Line K). Thereafter, the tie rod 80 is shifted back (Line L) and the clamp or clip 78 is again closed (Line K). Then, the swivel arm 79 also swings back again entirely to facilitate the can exchange (Line J). The manipulator carrier 102 now travels toward the left-hand side so that the filled sliver can can be transported onto the turntable (Line A). The full-can manipulator 75*a* then travels frontwards (Line D). Then the full can stirrups 130 is opened by lowering it. (Line E).

Thereafter, the full-can manipulator 75*a* again travels back to the neutral position (Line D). Also, the manipulator carrier 102 now travels back again into the middle position thereof (Line A). By switching-on the motor 216*a* for left-hand running, the turntable is turned back 90° into the operating position thereof (Line G). When that has occurred, the drive 92*a* for the turntable also travels back into the neutral position thereof (Line F). Swivel arm 79 (Line J) and can-fullness measuring device 87 (Line M) are driven likewise back again to the neutral positions thereof. The can-exchanging device 54 is accordingly now ready for further travel.

The other three can-exchanging programs operate similarly, however, the switching-on of the turntable drive is partly eliminated or the direction of rotation is changed when turning the turntable.

The program of the can-exchanging device 54 during can-exchange at the loading station proceeds as follows:

Empty-can manipulator 75*b* (Line B) and full-can manipulator 75*a* (Line D) are then driven backwards ad simultaneously, both drives 92 (Line H) and 92*a* (Line F) for the turntable swing to the side so that space for the can exchange is provided. Simultaneously, the swivel arm 79 (Line J) swings backwards so as to take out of the clamp the sliver end of the sliver can to be taken up. In addition, the clamp 78 is briefly opened (Line K). During the take-over of the sliver end, the tie rod 80 is withdrawn (Line L).

In the interim, the load station is switched on and completes the can transfer or take-over according to its own program (Line N). The exchange of the sliver cans is aided by the lowering of the empty-can stirrups 130*a* (Line C) and the raising of the full-can stirrups 130 to receive the filled sliver can (Line E). When the can exchange is completed, the swivel arm 79 (Line J) swings back into the neutral position thereof. Also, the manipulator 75*b* (Line B) and 75*a* (Line D) again travel into their neutral positions. The can-exchanging device 54 is thus again ready for further travel.

I claim:

1. Method of exchanging sliver cans of a spinning machine having individual spinning stations, the sliver cans being disposed in staggered array adjacent and behind one another, by means of a can exchanging device able to travel on a given travel path along the spinning machine which comprises placing the sliver cans in groups of at least three cans on turntables installed below the respective spinning stations of the spinning machine, conducting the can-exchanging device with at least one filled sliver can carried thereby in operating readiness past the groups of at least three cans at the respective spinning stations, stopping at a respective spinning station in response to a signal "sliver missing" from the spinning station and automatically carrying out the following operating steps:

(a) turning the turntable into can-exchanging position if the turntable is not already in such position;
(b) removing from the turntable the sliver can to be exchanged;
(c) delivering the filled sliver can from the can-exchanging device to the turntable;
(d) turning the turntable back into operating position thereof if necessary;
(e) conducting the can-exchanging device to a loading station and surrendering thereto the removed sliver can; and
(f) providing the can-exchanging device with another filled sliver can to be carried thereby.

2. Method according to claim 1 which comprises transmitting a signal to commence joining from the can-exchanging device after the can-exchanging step has been performed.

3. Method according to claim 1 which comprises sensing the extent of fullness of the sliver can to be exchanged and upon determining the presence therein of an adequately full can, aborting the can exchange and signaling to commence joining.

4. Method according to claim 1 which comprises previously filling the sliver cans placed in groups of at least three cans on the respective turntables with sliver of varying extents of fullness.

5. In combination, a can-exchanging device constrained to travel on a given path along a spinning machine having a plurality of individual spinning stations, comprising turntables disposed below the respective spinning stations for carrying sliver cans in groups of at least three cans for each turntable, means on said can-exchanging device for carrying at least one filled sliver can in operating readiness past said turntables at the respective spinning stations, means responsive to a signal "sliver missing" from a spinning station for stopping said can-exchanging device at the respective spinning station, and means for automatically performing the following functions:

(a) turning said turntable into can-exchanging position if said turntable is not already in such position;
(b) removing from said turntable the sliver can to be exchanged;
(c) delivering the filled sliver can from the can-exchanging device to said turntable;
(d) turning said turntable back into operating position thereof if necessary;
(e) conducting the can-exchanging device to a loading station and surrendering thereto the removed sliver can; and
(f) providing the can-exchanging device with another filled sliver can to be carried thereby.

6. Combination according to claim 5 including programmable can-exchanging means for moving the sliver cans in more than one displacement direction with respect to the can-exchanging device per se.

7. Combination according to claim 5 including a cleaning and joining device.

8. Combination according to claim 5 including a programmable couplable and uncouplable drive for said turntables.

9. Combination according to claim 5 including sensor means for determining extent of fullness of sliver cans to be exchanged.

10. Combination according to claim 5 including means for signalling termination of an exchange operation to servicing personnel.

11. Combination according to claim 5 including at least one displaceable programmed clamping means for sliver ends.

12. Combination according to claim 5 wherein the means for moving the sliver cans are also for surrendering and taking-over the sliver cans at a loading station.

13. Combination according to claim 5 including a loading station, and a transporting device at said loading station, said transporting device being shiftable toward said can-exchanging device for facilitating can transfer.

14. Combination accorcing to claim 13 including a sliver drawing mechanism, a can-filling device connected thereto, and means for holding the sliver ends and for transferring the sliver ends to said can-exchanging device.

* * * * *